US005882086A

United States Patent [19]

Bremner et al.

[11] Patent Number: 5,882,086

[45] Date of Patent: Mar. 16, 1999

[54] FLOATING HEAD CUTTER MECHANISM FOR REMOVING TRAFFIC MARKINGS

[76] Inventors: Clifford P. Bremner; Andrew P. Bremner, both of 290 Hampton Heath Rd., Burlington, Ontario, Canada, L7L 4P5

[21] Appl. No.: 822,498

[22] Filed: Mar. 24, 1997

[51] Int. Cl.[6] ..... E01C 23/088

[52] U.S. Cl. ..... 299/41.1; 451/353

[58] Field of Search ..... 299/39.1, 39.4, 299/39.6, 41.1; 404/90, 91, 94; 451/353, 352

[56] References Cited

U.S. PATENT DOCUMENTS

| | | | |
|---|---|---|---|
| 1,000,696 | 8/1911 | Schlueter | 299/39.6 |
| 2,171,060 | 8/1939 | Spirt | 451/353 |
| 2,349,949 | 5/1944 | Farrell | 299/39.4 |
| 2,987,741 | 6/1961 | Feldman | 15/4 |
| 3,129,539 | 4/1964 | Tempero | 451/353 |
| 4,099,328 | 7/1978 | Schlemmer | 30/172 |
| 4,405,177 | 9/1983 | Yamashita | 299/41.1 |
| 4,634,188 | 1/1987 | Persson | 299/40.1 |
| 4,654,918 | 4/1987 | Cooper | 15/98 |
| 4,714,295 | 12/1987 | Wirtgen | 299/39.6 |
| 4,723,867 | 2/1988 | Wirtgen | 404/90 |
| 4,909,575 | 3/1990 | Lupton | 299/39.5 |
| 4,910,824 | 3/1990 | Nagayama | 15/98 |
| 5,063,713 | 11/1991 | Buchheit | 451/344 |
| 5,081,734 | 1/1992 | Sanford | 15/93.1 |
| 5,127,124 | 7/1992 | Palmer | 15/98 |
| 5,234,864 | 8/1993 | Lenaburg | 175/373 |
| 5,605,381 | 2/1997 | Schmoock | 299/39.2 |

FOREIGN PATENT DOCUMENTS

| | | |
|---|---|---|
| 0 098 798 | 1/1984 | European Pat. Off. . |
| 0 133 961 | 3/1985 | European Pat. Off. . |
| 0 284 391 | 9/1988 | European Pat. Off. . |
| 2 563 546 | 10/1985 | France . |
| 27 10 140 | 10/1977 | Germany . |
| 35 06 551 | 9/1986 | Germany . |
| 89 11 435.3 | 12/1989 | Germany . |
| 1-174709 | 7/1989 | Japan . |
| W0 93/18235 | 8/1993 | WIPO . |

*Primary Examiner*—David J. Bagnell
*Attorney, Agent, or Firm*—Lee, Mann, Smith, McWilliams, Sweeney & Ohlson

[57] ABSTRACT

A vehicle having three or more wheels, supporting substantially all of the vehicle weight on its wheels, for removing a traffic marking from a road surface, has a vertically floating head cutter mechanism comprising a mounting shroud having an open bottom and being suspended from the vehicle in substantially vertically movable relation with respect to the vehicle by two or more vertical guides. The vertical guides define upper and lower limits of vertical travel of the mounting shroud and are dimensioned and otherwise adapted to locate the mounting shroud in an operative intermediate position between the upper and lower limit positions. First and second cutter head assemblies are operatively mounted within the mounting shroud adjacent the open bottom for counter-rotation about respective first and second axes, which axes are preferably canted from zero degrees to ten degrees to the vertical. Hydraulic drive motors are operatively connected to the first and second cutter head assemblies for causing the counter-rotation thereof. Biasing springs and hydraulically actuated cylinders are interconnected between the mounting shroud and the vehicle for biasing the mounting shroud towards the lower limit position and for resiliently urging the first and second cutter head assemblies into cutting engagement with the road surface through the open bottom of the mounting shroud, with a substantially constant cutting force applied by each cutter head assembly to the road surface irrespective of irregularities encountered in the road surface as the vehicle moves therealong.

38 Claims, 19 Drawing Sheets

151a
151
173
157
145
143
150
150o
161a
167u
159
151e
153
167l
"D"
"E"
222
221
"D"
210
212b
101
102
163t
163
161l
165
169
168p
168r
151l
"E"
223
149
153l
170
171
176
"I"
225
226
175
151b
178r
178o
"I"
172
174
181
171
179a
179r
180b
182
187r
187b
187a
"C"
186
185a
184o
232
183a
"K"
"K"
184i
230b
189o
189
184
173
"J"
230
183i
179a
179r
180a
182
185b
183o
232
"K"
"K"
184i
184o
185a
187r
187a
"C"
186
131
230a

FLOATING HEAD CUTTER MECHANISM FOR REMOVING TRAFFIC MARKINGS

FIELD OF THE INVENTION

The present invention relates to machines for removing traffic markings from a road surface, and more particularly to such a vehicle or machine having a vertically floating head cutter mechanism that permits application of a constant cutting force by the cutter head mechanism to the road surface irrespective of irregularities encountered in the road surface.

BACKGROUND OF THE INVENTION

It is common to paint assorted patterns of traffic markings, such as center lines, directional arrows, and the like, on various types of road surfaces. Such road surfaces may include roads and parking lots, and so on, made from asphalt, concrete, or similar material. Such traffic markings are usually applied using special types of paints that permeate into the asphalt or concrete perhaps as much as a millimeter, so that the traffic markings do not readily wear off. Accordingly, in the event that it is necessary to remove the traffic markings, it is difficult to perform such removal without also removing a portion of the underlying road surface.

Prior art traffic marking removers comprise small manually motive powered devices having a single cutter head assembly mounted on a main body for rotation of the cutter head assembly about a vertical axis. The cutter head assembly typically comprises a base member securely mounted on a drive shaft for rotation therewith about the vertical axis, which drive shaft is mounted in a housing by means of a pair of cooperating drive shaft bearings. A plurality of cutter heads are rotatably mounted on the base member in radially projecting relation thereto, each by means of a pair of cooperating cutter head bearings engaged on respective stub axles secured to the base member. The cutter heads are at all times, when in use, in contact with the road surface having a traffic marking to be removed therefrom.

Accordingly, prior art traffic marking removers remove traffic lines by cutting a shallow rut in the road surface, which rut has substantially vertical sides separated by a span substantially the same width as the diameter of the cutter head assembly. The creation of such ruts is undesirable, since vehicle tires tend to get caught by the substantially vertical sides, which may be dangerous, especially at high speeds.

Also, most prior art traffic marking removers tend to remove uncontrolled varying amounts of road surface, due to an inability to accurately control the downwardly directed pressure of the cutter heads on the road surface. It is usually not possible for prior art traffic marking removers to apply a constant cutting force by the cutter head mechanism to a road surface having a traffic marking removed therefrom, especially at locations where dips, bumps or other irregularities are encountered in the road surface. Thus, using prior art traffic marking removers, the vertical depth of road surface removed might easily vary along the length of the traffic marking being removed from virtually nothing removed, to far too much removed. As a consequence, in order to ensure that the marking is completely removed along its entire length, it is necessary with prior art equipment to remove an excessive amount of road surface, thereby creating an excessively deep rut along at least some portion of the length of the marking. It can be readily understood that the deeper the rut, the greater the danger of a vehicle tire being caught in the rut. It is also common for water to accumulate in the ruts thus created, which is undesirable, and unsafe, especially if the water freezes.

Indeed, it has been found, that in many jurisdictions, governmental bodies responsible for the maintenance of roads have set forth specifications for traffic marking removal on some road surfaces, such as highways, which specifications usually cannot be met by prior art traffic marking removers, especially if the road surface is uneven. It is often only through chance that a traffic line removal done by a prior art traffic marking remover apparatus conforms to such specifications.

Also, since prior art traffic marking removers have only a single cutter head assembly, the torque from the engagement of the single cutter head assembly with a road surface is counteracted only by the weight of the traffic marking remover and the strength of the operator. Accordingly, prior art traffic marking removers are operated at a cutter head assembly speed of about 300 to 500 r.p.m. so as to minimize such torque. Even at that slow speed, however, prior art traffic marking removers tend to draw themselves off the course intended by the operator, which is unacceptable. Also, due to the slow rotational speed of the cutter head assembly, traffic marking removal tends to be quite slow. A typical rate of progress is in the order of about one kilometer per day, per machine.

Another significant problem with prior art traffic marking removers is that of an unacceptable short useful life of drive shaft bearings and cutter head bearings. The drive shaft bearings and cutter head bearings are constantly, during use, subjected to a substantial lateral load. The drive shaft bearings and cutter head bearings are not typically lubricated, and thus generate a substantial amount of heat. It has been found that the temperature of drive shaft bearings and cutter head bearings may reach temperatures in the order of 350 degrees F. Such high temperatures tend to substantially accelerate the wear of drive shaft bearings and cutter head bearings.

Further, the drive shaft bearings and cutter head bearings are subjected to asphalt or concrete dust and debris created by the cutting operation, which dust and debris tend to settle in the bearings. Accordingly, the bearings tend to wear out very quickly, or suddenly seize, and therefore must be replaced as frequently as every day, or even more frequently, depending on the particular application, which replacement is extremely undesirable in terms of unproductive down time and in terms of the actual cost of the bearing replacement.

Yet another significant problem with prior art traffic marking removers is that of flat spots on the generally circular perimeter cutter heads. As the cutter head bearings become worn or contaminated by dust and debris, the cutter heads rotate less freely, which increases the likelihood that a perimeter section of the teeth of the cutter head that are in cutting contact with the road surface, will remain in said cutting contact with the road surface. Accordingly, these teeth tend to become worn so as to create a "flat spot", which worn teeth do not effectively cut the road surface. Once a flat spot comes into existence on a cutter head, the cutter head will rotate until the flat spot is in contact with the road surface, and will remain in contact with the road surface, thus accelerating the wear of the already overly worn teeth. The cutter head must then be replaced in order to achieve proper cutting of a road surface. It is common for cutter heads to be replaced quite frequently, perhaps even daily, depending upon the nature of the job conditions, which is extremely undesirable in terms of unproductive down time and in terms of the high replacement cost of the cutter heads. Such frequent replacement of the cutter heads would cause traffic marking removal to be even slower than an expected rate of progress of about one kilometer per day, per machine.

Further, it has been found that using cutter heads with flat spots also tends to cause excessive wear on the cutter head bearings.

It is an object of the present invention to provide a vehicle for removing a traffic marking from a road surface, which vehicle has a vertically floating cutter head mechanism.

It is another object of the present invention to provide a vehicle for removing a traffic marking from a road surface, which vehicle has cutter heads that are intermittently in contact with a road surface, so as to ensure rotation of the cutter heads, thereby to prevent flat spotting of the cutter heads.

It is another object of the present invention to provide a vehicle for removing a traffic marking from a road surface, and having a vertically floating cutter head mechanism, which vehicle removes a readily controllable depth of underlying road surface.

It is a further object of the present invention to provide a vehicle having a vertically floating cutter head mechanism, for removing a traffic marking from a road surface, which vehicle does not cut a substantially vertically sided rut in the road surface.

It is yet a further object of the present invention to provide a vehicle having a vertically floating cutter head mechanism, for removing a traffic marking from a road surface, which vehicle applies a substantially constant cutting force to the road surface, irrespective of irregularities in the road surface.

It is yet another object of the present invention to provide a vehicle having a vertically floating cutter head mechanism, for removing a traffic marking from a road surface, which vehicle does not exceed a maximum specified depth of cut in a road surface.

It is yet a further object of the present invention to provide a vehicle having a vertically floating cutter head mechanism, for removing a traffic marking from a road surface, which vehicle has a significantly faster travelling speed that prior art machines for the same use.

It is yet a further object of the present invention to provide a vehicle having a vertically floating cutter head mechanism, for removing a traffic marking from a road surface, which vehicle does not draw itself off course.

It is yet a further object of the present invention to provide a vehicle having a vertically floating cutter head mechanism, for removing a traffic marking from a road surface, which vehicle has drive shaft bearing and cutter head bearing temperatures significantly less than prior art machines for the same use, so as to prevent bearing overheating and/or failure.

It is still a further object of the present invention to provide a vehicle having a vertically floating cutter head mechanism, for removing a traffic marking from a road surface, which vehicle has increased drive shaft bearing life over prior art machines for the same use.

It is still a further object of the present invention to provide a vehicle having a vertically floating cutter head mechanism, for removing a traffic marking from a road surface, which vehicle has increased cutter head bearing life over prior art machines for the same use.

It is yet a further object of the present invention to provide a vehicle having a vertically floating cutter head mechanism, for removing a traffic marking from a road surface, which vehicle has increased cutter head life over prior art machines for the same use.

It is still another object of the present invention to provide a vehicle having a vertically floating cutter head mechanism, for removing a traffic marking from a road surface, which vehicle resists flat spots from being produced on the teeth of the cutter heads utilized in the cutter mechanism.

SUMMARY OF THE INVENTION

In accordance with the present invention there is disclosed a vehicle having three or more wheels, supporting substantially all of the vehicle weight on its wheels, for removing a traffic marking from a road surface, and having a vertically floating head cutter mechanism comprising a mounting shroud having an open bottom and being suspended from the vehicle in substantially vertically movable relation with respect to the vehicle by two or more vertical guide means, which vertical guide means define upper and lower limits of vertical travel of the mounting shroud and are dimensioned and otherwise adapted to locate the mounting shroud in an operative intermediate position between the upper and lower limit positions. First and second cutter head assemblies are operatively mounted within the mounting shroud adjacent the open bottom of the mounting shroud for counter-rotation about respective first and second axes. The first and second axes are each preferably inclined at an angle of between zero degrees and ten degrees with respect to vertical, with the first drive axis being is inclined forwardly and upwardly, and the second drive axis being inclined rearwardly and upwardly. Drive means are operatively connected to the first and second cutter head assemblies for causing the counter-rotation thereof. The drive means preferably comprises first and second drive shafts operatively rotatably mounted in respective first and second housings affixed to the mounting shroud, with generally centrally disposed bores within the first and second housings each being adapted to contain a bath of lubricant for lubrication of cooperating upper and lower tapered roller bearings in which the drive shafts are rotatably mounted. Biasing means are interconnected between the mounting shroud and the vehicle for biasing the mounting shroud towards the lower limit position and for resiliently urging the first and second cutter head assemblies into cutting engagement with the road surface through the open bottom of the mounting shroud, with a substantially constant cutting force applied by each cutter head assembly to the road surface irrespective of irregularities encountered in the road surface as the vehicle moves therealong.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

The novel features which are believed to be characteristic of the vertically floating head cutter mechanism for use in a vehicle for removing a traffic marking from a road surface, according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF A PREFERRED EMBODIMENT

Figure 1:
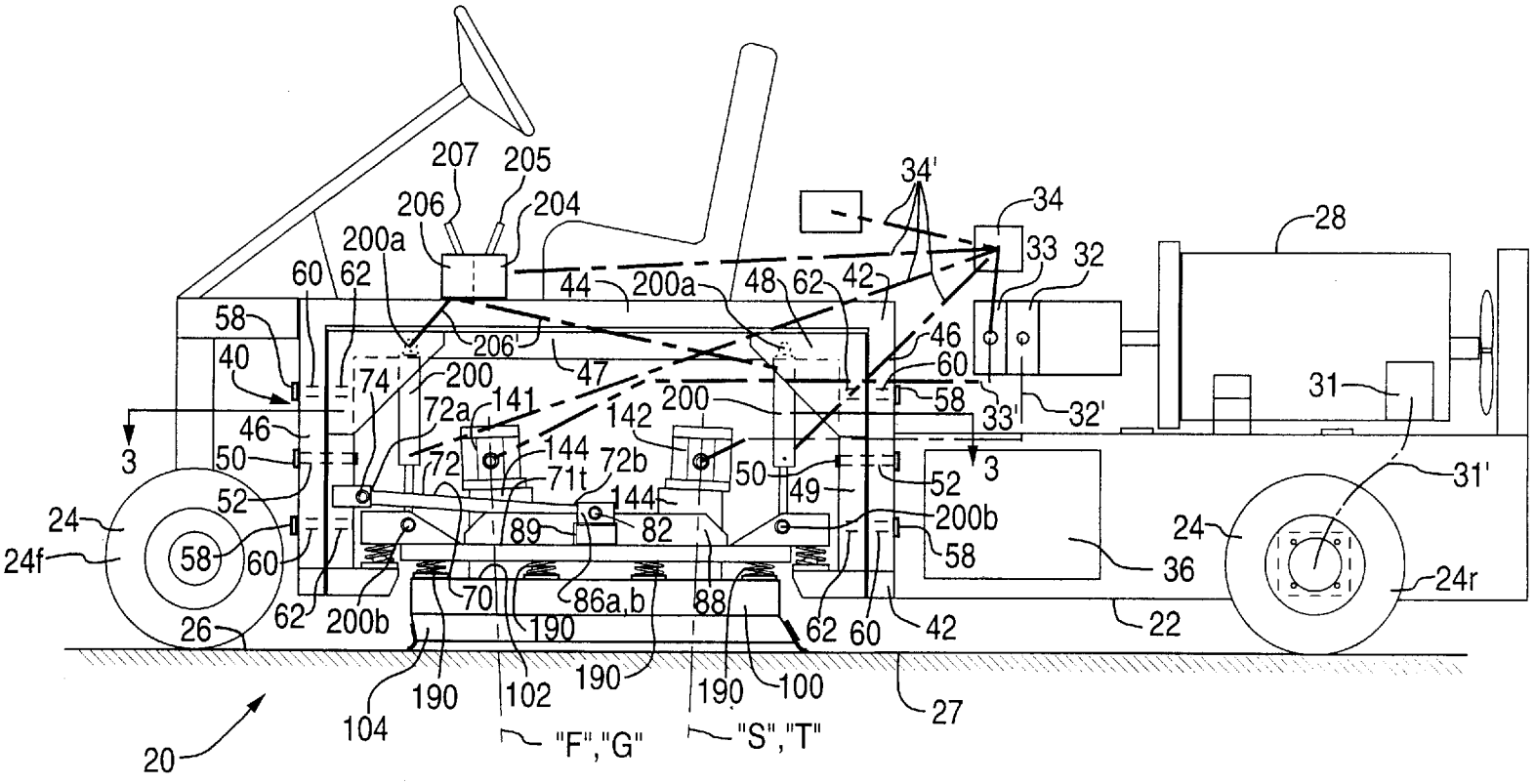
FIG. 1 is a side elevational view of a vehicle having a preferred embodiment of the vertically floating head cutter mechanism according to the present invention installed thereon, in use removing a traffic marking from a road surface.

Referring now to the Figures, there will be seen a preferred embodiment of a vertically floating head cutter mechanism, which mechanism is indicated by the general reference numeral 20. The vertically floating head cutter mechanism is for use on a vehicle 22, as can be best seen in FIG. 1, which vehicle 22 is for removing traffic markings 26, such as traffic lines, directional arrows, and the like, from a road surface 27, constructed from asphalt, concrete, or similar materials. The vehicle 22 has three or more wheels for the sake of stability, and preferably has four wheels 24, specifically two front wheels 24*f* and two rear wheels 24*r*, which wheels 24*f* and 24*r* and support substantially all of the vehicle weight. A diesel engine 28 is preferably mounted toward the rear of the vehicle 22, and powers all of the systems of the vehicle 22, through first 31, second 32, third 33, and fourth 34 hydraulic motors. The first hydraulic motor 31 is used to drive the rear wheels 24*r* of the vehicle 22 through hydraulic lines 31'. The second 32 and third 33 hydraulic motors are used to drive cutter heads of the vehicle 22 through hydraulic lines 32' and 33', respectively, in a conventional manner. The fourth hydraulic motor 34 is used to drive other hydraulic systems the of the vehicle 22 through hydraulic lines 34', as will be discussed in greater detail subsequently. A reservoir 36 conventionally supplies hydraulic fluid for the first 31, second 32, third 33, and fourth 34 hydraulic motors.

Figure 3:
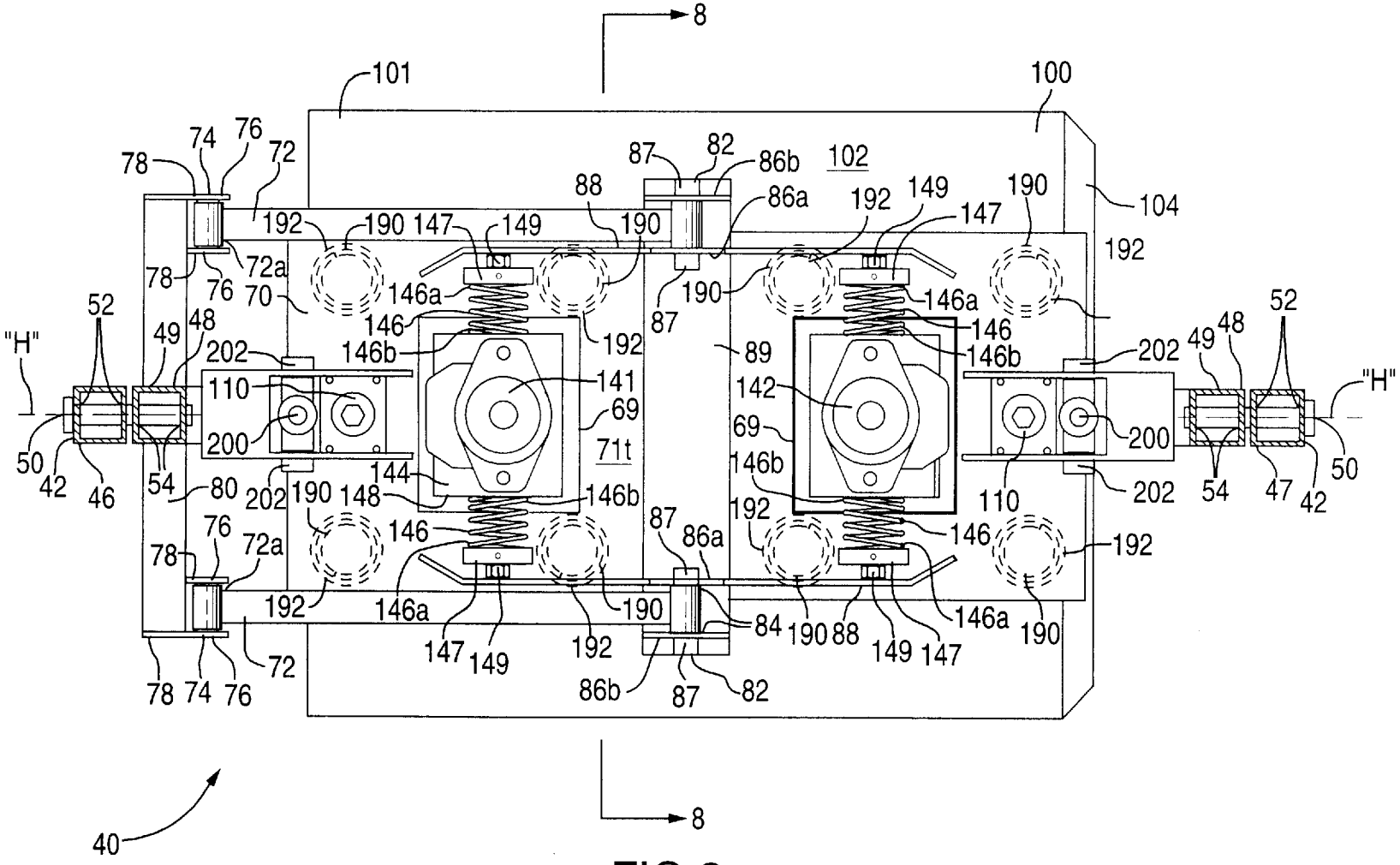
FIG. 3 is a sectional top plan view similar to FIG. 1, taken along section line 3—3 of FIG. 1.
Figure 4:
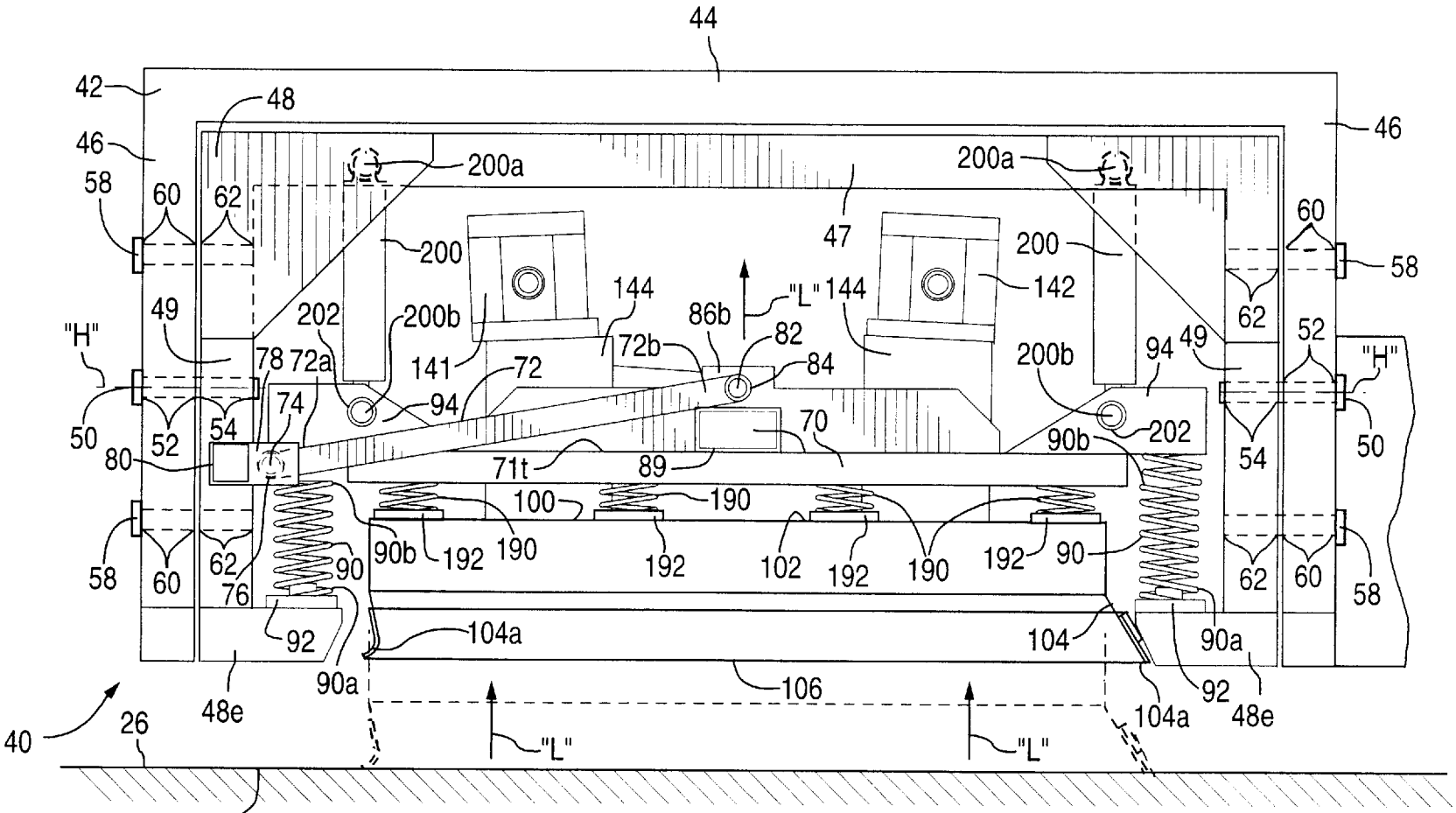
FIG. 4 is a side elevational view of the vertically floating head cutter mechanism of FIG. 1 shown in a raised inoperative position, indicated by solid lining, and shown in a lowered in-use position, with the mounting shroud of the vertically floating head cutter mechanism indicated by phantom lining.
Figure 5:
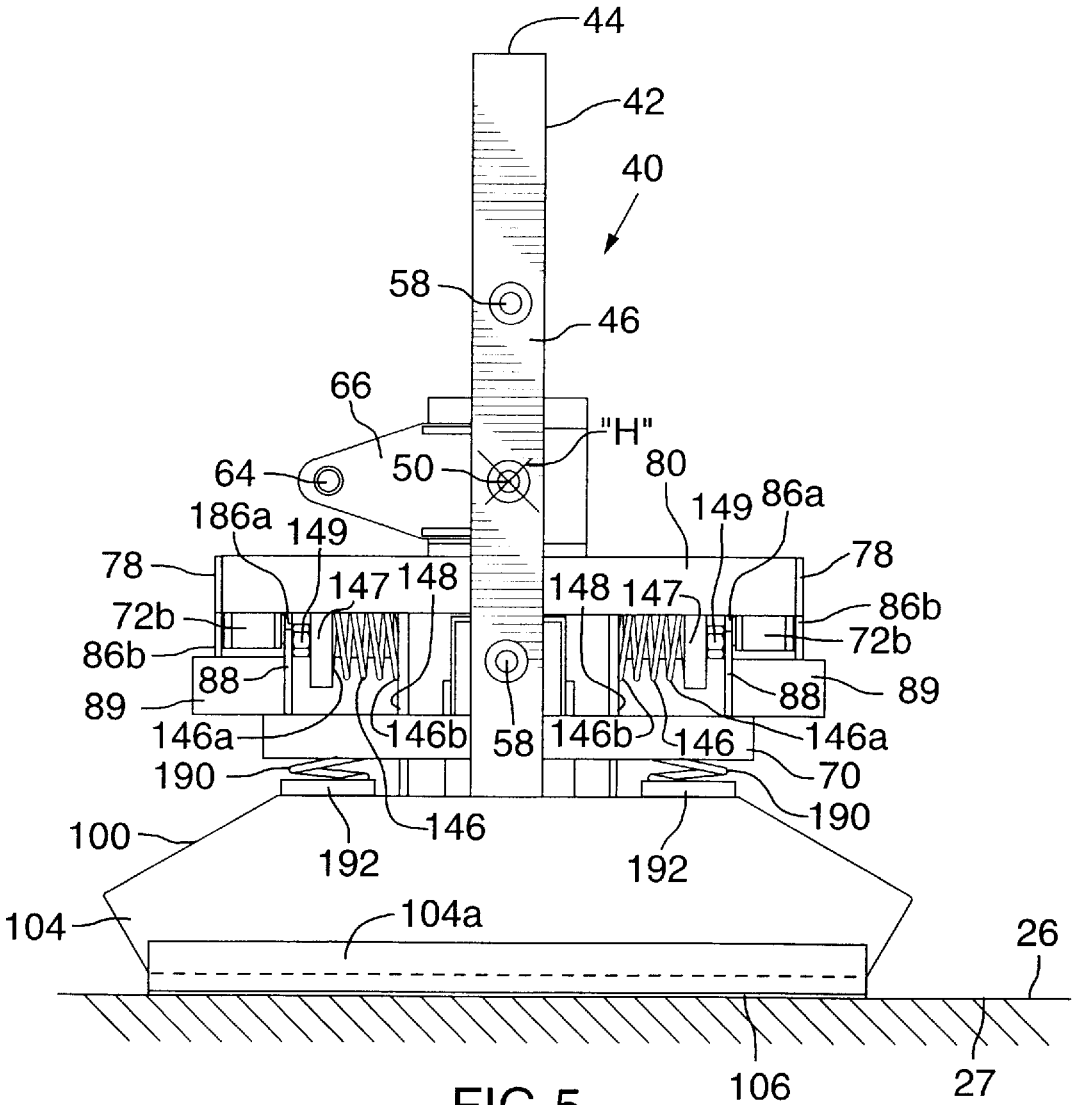
FIG. 5 is an end elevational view of the vertically floating head cutter mechanism of FIG. 1.
Figure 6:
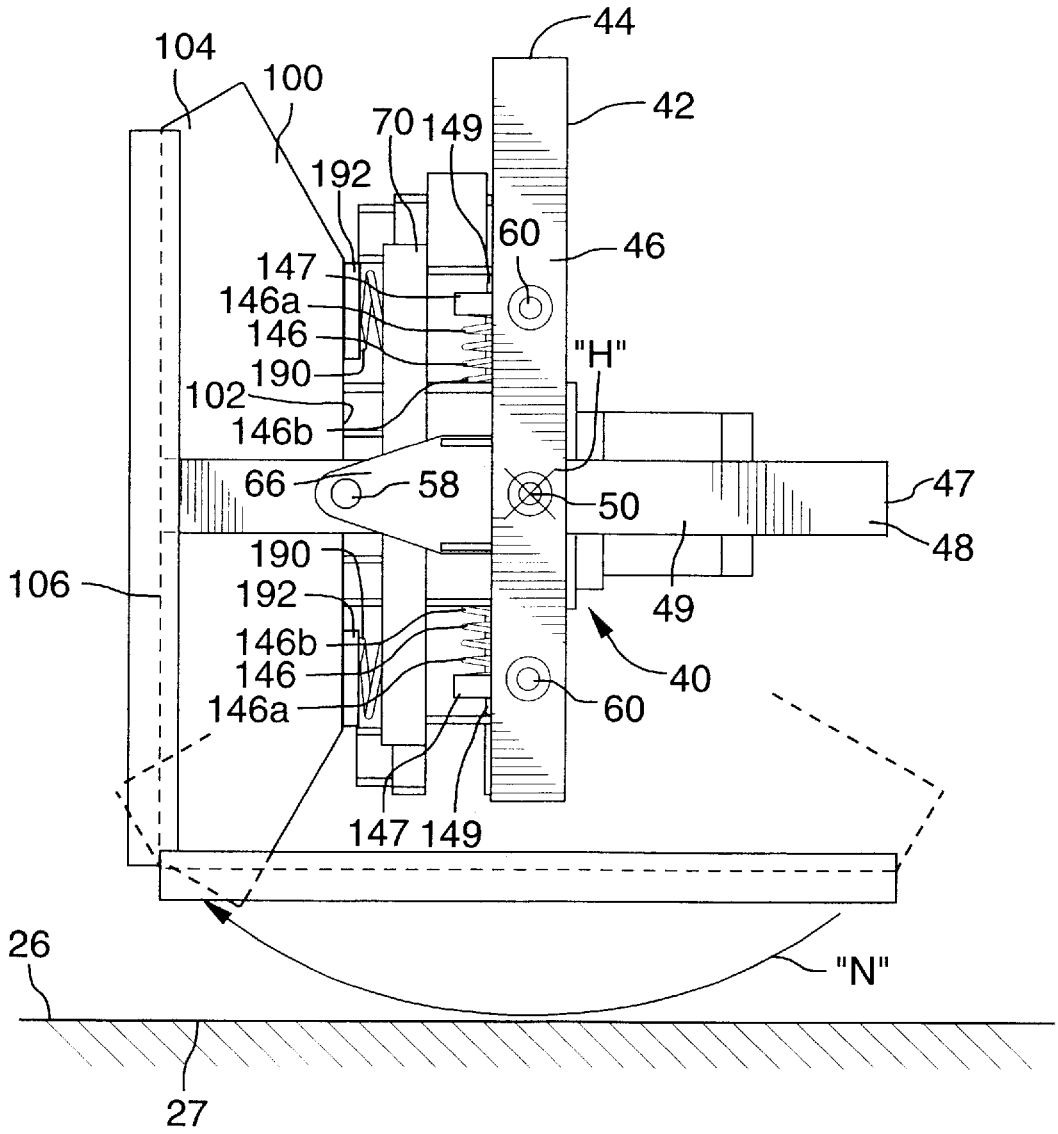
FIG. 6 is an end elevational view similar to FIG. 5, with the vertically floating head cutter mechanism shown in a raised inoperative position, and with the mounting shroud shown in phantom lining in an in-use configuration and shown in solid lining in a rotated access configuration.

The vertically floating head cutter mechanism 20 is preferably mounted on the vehicle 22 by means of a mounting frame, as indicated by general reference numeral 40, as can be best seen in FIGS. 1 through 6. The mounting frame 40 comprises an inverted "U"-shaped stationary member 42 having a substantially horizontally disposed cross member 44 rigidly connected at each of its opposite ends to respective transverse arm portions 46,46. Both the substantially horizontally disposed cross members 44 and the two substantially vertically disposed arm members 46,46 of the stationary member 42 are rigidly secured to the vehicle 22 by conventional means, such as threaded fasteners and/or welding (not shown). The mounting frame 40 further comprises a smaller inverted "U"-shaped pivoting member 48 that is substantially congruent to the inverted "U"-shaped stationary member 42. The inverted "U"-shaped pivoting member 48 has a horizontally disposed cross member 47 rigidly connected at each of its opposite ends to respective transverse arm portions 49,49, and is operatively mounted in nesting relation within the inverted "U"-shaped stationary member 42 by means of axially aligned horizontally disposed pivot pin members 50 retained in cooperating apertures 52 in the vertically disposed arm portions 46,46 of the inverted "U"-shaped stationary member 42 and in cooperating apertures 54 in the vertically disposed arm portions 49,49 of the inverted "U"-shaped pivoting member 48. The inverted "U"-shaped pivoting member 48 is thus mounted for selective pivotal movement through at least ninety degrees of movement, as is indicated by arrow "N" in FIG. 6, about a substantially horizontal axis "H" passing through the axially aligned pin members 50, between an in-use configuration, as is best seen in FIG. 5 and as is partially illustrated in phantom lining in FIG. 6, and an access configuration, shown in FIG. 6 in solid lining. Both FIGS. 5 and 6 show the vertically floating head cutter mechanism 20 in its raised inoperative position.

In the in-use configuration, the vertically floating head cutter mechanism 20 is oriented for removing traffic markings 26 from a road surface 27, once the vertically floating head cutter mechanism 20 is positioned to its lowered in-use position. In the access configuration shown in FIG. 6, the various components of the vertically floating head cutter mechanism 20 are more readily accessible for maintenance purposes. The vertically floating head cutter mechanism 20 is retained in the in-use configuration by selective removable insertion of two opposed pairs of pin members 58, disposed one pair in each of the two adjacent pairs of arms 46 and 49 of the inverted "U"-shaped stationary member 42 and the inverted "U"-shaped pivoting member 48, respectively, through respective aligned apertures 60 and 62 in the arms 46 and 49. The vertically floating head cutter mechanism 20 is retained in its access configuration by selective removable insertion of the pin members 58 through apertures 64 in transverse extension plates 66 secured to the arm portions 46,46 of the inverted "U"-shaped stationary member 42 into the apertures 62 in the arm portions 49 of the inverted "U"-shaped pivoting member 48.

Figure 9A:
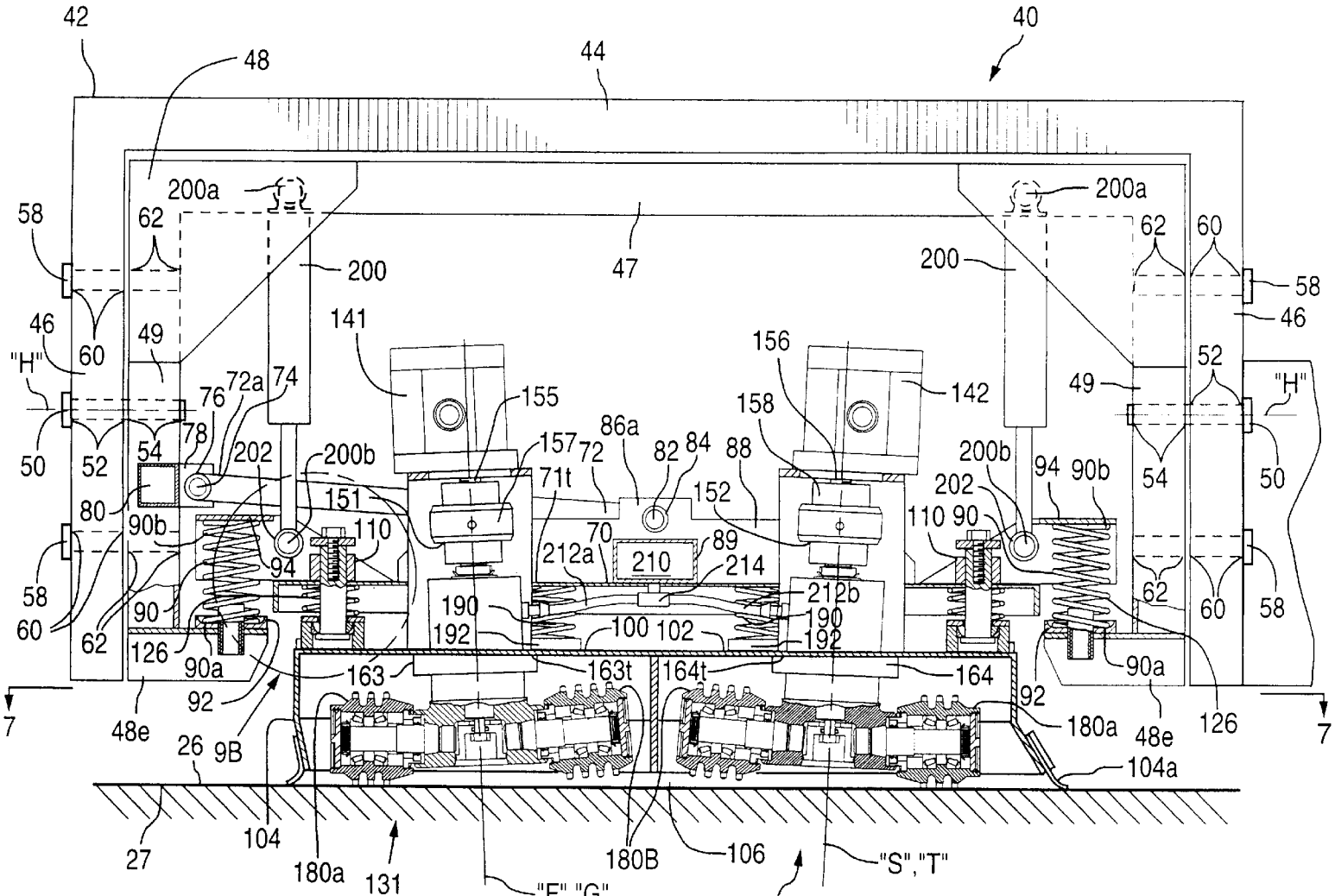
FIG. 9A is a vertical sectional view of the vertically floating head cutter mechanism of FIG. 1, taken along section line 9—9 of FIG. 3.

As can best be seen in FIGS. 4 and 9A, an intermediate platform 70 is mounted in suspended relation from the vehicle 22 by a pair of substantially parallel linking arms 72. The intermediate platform 70 is preferably made from ¼" steel plate for reasons of strength and rigidity. The pair of substantially parallel linking arms 72 are pivotally mounted at their fixed ends 72*a* to the vehicle 22, for concurrent pivotal movement about a common pivot axis "A", each by means of a mounting pin 74 passing through aligned apertures 76 in a pair of opposed flanges 78 rigidly secured to a horizontal support arm 80. The horizontal support arm 80 in turn is rigidly secured to one of the arm portions 49 of the inverted "U"-shaped pivoting member 48. The pair of substantially parallel linking arms 72 are pivotally mounted at their opposite moving ends 72*b* each by means of a mounting pin 82 passing through aligned apertures 84 in a pair of inner 86*a* and outer 86*b* opposed mounting flanges rigidly secured to a laterally disposed elongate lubricant reservoir 89 mounted on the top surface 71*t* of the intermediate platform 70. The opposed inner 86*a* and outer 86*b* mounting flanges 86 each have an extended collar portion 87 to retain the mounting pin 82 in properly aligned non-binding relation in the respective apertures 84. The inner mounting flanges 86*a* are each part of a vertically and longitudinally disposed mounting plate 88.

The pair of substantially parallel linking arms 72, assist in controlling movement of the intermediate platform 70 between the lower zone of engagement positions, as shown in FIGS. 5, 9A, and 13A through 13F, and an upper zone of non-engagement positions, as shown in solid lining in FIG. 4. The lower zone of engagement positions of the intermediate platform 70 correspond to lowered in-use positions of the vertically floating head cutter mechanism 20, and the upper zone of non-engagement positions of the intermediate platform 70 correspond to raised inoperative positions of the vertically floating head cutter mechanism 20.

In order to assist in lifting the intermediate platform 70 from its lower zone of engagement positions and the upper zone of non-engagement positions, two lifting springs 90 are operatively disposed between the vehicle 22 and the intermediate platform 70. Each lifting spring 90 is retained at its bottom end 90*a* in a cap member 92 secured to a horizontally disposed longitudinally extending end portion 48*e* of a respective arm portion 49 of the inverted "U"-shaped pivoting member 48. Downwardly open channel-shaped extensions 94 are rigidly secured one at each end of the intermediate platform 70 in outwardly projecting relation to receive the top end 90*b* of the respective lifting spring 90. The two lifting springs 90 substantially offset the weight of the vertically floating head cutter mechanism 20 to resiliently assist in the suspended, floating motion thereof.

Figure 9B:
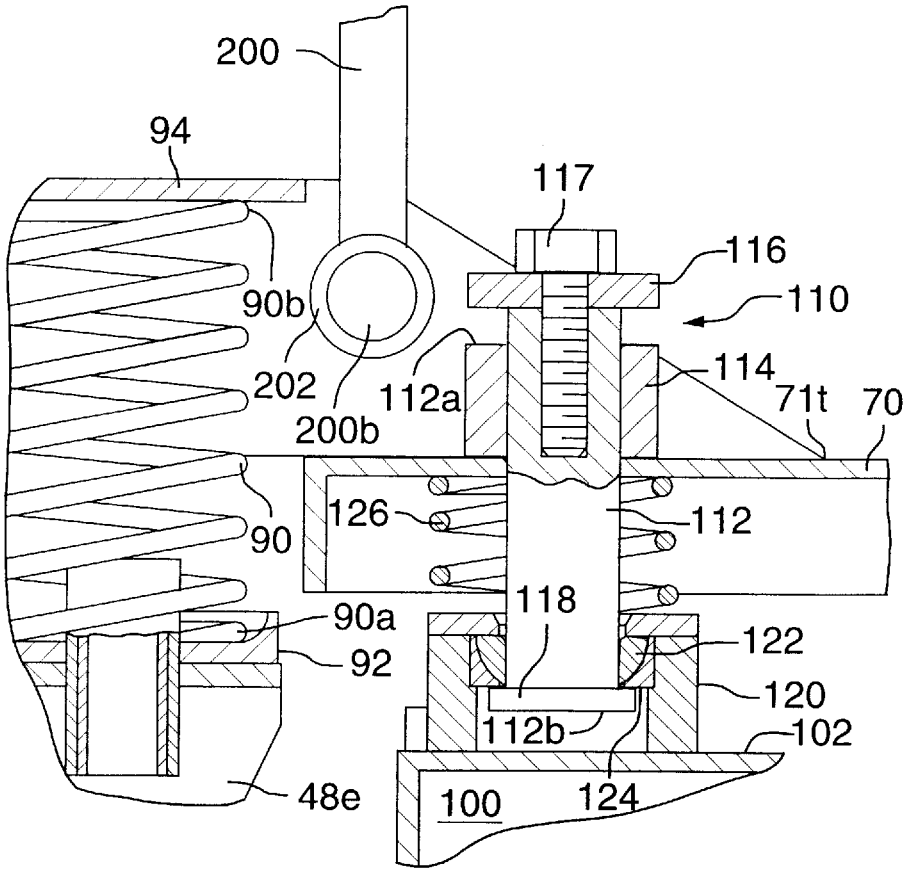
FIG. 9B is an enlarged vertical sectional view of the portion of the area of FIG. 9A encircled by dashed lining.

The vertically floating head cutter mechanism 20 also comprises a mounting shroud 100 having a substantially horizontal central deck 102, a skirt portion 104 downwardly depending from the substantially horizontal central deck 102, a flexible skirt seal 104*a* adjacent the lower perimeter of the skirt portion 104, and an open bottom 106 defined by the skirt seal 104*a*. The mounting shroud 100 is suspended from the vehicle 22 in substantially vertically movable relation with respect to the vehicle 22 by two or more vertical guide means, which vertical guide means comprise, in the preferred embodiment, two vertical guide assemblies 110, as can best be seen in FIG. 9B. The two vertical guide assemblies 110 are operatively interconnected between the intermediate platform 70 and the mounting shroud 100, and will now be described in detail with reference to only one of the two substantially identical mechanisms. Each vertical guide assembly 110 has a vertically oriented shaft 112 disposed in sliding relation within an internal bearing sleeve 114, which internal bearing sleeve 114 is welded or otherwise rigidly affixed to the top surface 71*t* of the intermediate platform 70. A robust washer 116 is securely threadibly engaged into the top end 112*a* of the vertically oriented shaft 112 by a bolt 117 to limit the downward travel of the vertically oriented shaft 112 in the internal bearing sleeve 114. A flange 118 at the bottom end 112*b* of the vertically oriented shaft 112 is retained within a bearing block 120 securely welded to the top surface 101 of the mounting shroud 100. The flange 118 engages a spherical plain bearing 122 mounted on an annular shoulder 124 within the bearing block 120 to accommodate limited angular movement of the mounting shroud 100 with respect to the intermediate platform 70, thus precluding the vertical guide assemblies 110 from binding in the event that the vertically floating head cutter mechanism 20 becomes slightly angled, as it will often be during use.

It can be seen that the vertical guide assemblies 110 define upper and lower limit positions of vertical travel of the mounting shroud 100 relative to the intermediate platform 70, and are ideally dimensioned and otherwise adapted to accommodate about one inch of the vertical travel of the mounting shroud 100 between the upper and lower limit positions, preferably one half inch upwardly, and one half inch downwardly.

A positioning spring 126 disposed in each of the vertical guide assemblies 110 in surrounding relation to the shaft 112 biases the mounting shroud 100 and the intermediate platform 70 apart from each other, thus providing spacing between the mounting shroud 100 with respect to the intermediate platform 70, which spacing accommodates at least one half inch of upward travel of the mounting shroud 100 with respect to the intermediate platform 70. Further, there preferably exists a gap of about one half inch or more between the robust washer 116 and the top end 112*a* of the vertically oriented shaft 112. The two vertical guide assemblies 110, as described, locate the mounting shroud 100 in an operative intermediate position between the upper and lower limit positions, as can be best seen in FIG. 9B. Such intermediate positioning permits for both upward and downward travel of the mounting shroud 100 to accommodate irregularities in the road surface 27 as described more fully below.

The vertically floating head cutter mechanism 20 further comprises a first cutter head assembly, as indicated by the general reference numeral 131, and a second cutter head assembly, as indicated by general reference numeral 132, each operatively mounted within the mounting shroud 100 adjacent the open bottom 106 for counter-rotation about a first axis "F", and a second axis "S", respectively. It is not important which of the first 131 and second 132 cutter head assemblies rotates clockwise and which rotates counter-clockwise, but they should preferably counter-rotate. As can be best seen in FIG. 7, the first cutter head assembly 131 preferably rotates clockwise, as indicated by arrow "CW" in FIG. 7, and the second cutter head assembly 132 rotates counter-clockwise, as indicated by arrow "CCW" in FIG. 7, when the mounting shroud 100 is viewed from the top. Drive means comprising first 141 and second 142 hydraulic drive motors are operatively connected to the first 131 and second 132 cutter head assemblies, respectively, for causing the counter-rotation thereof. Such counter-rotation of the first 141 and second 142 hydraulic drive motors and the first 131 and second 132 cutter head assemblies ensures counterbalancing of the centrifugal torque from the first 141 and second 142 hydraulic drive motors to stabilize movement of the mounting shroud 100. The first 141 and second 142 hydraulic drive motors are each mounted above the central deck 102 of the mounting shroud 100 on a frame member 144 substantially directly above the first 131 and second 132 cutter head assemblies, respectively. Each frame member 144 extends upwardly from the mounting shroud 100 through a respective square opening 69 in the intermediate platform 70 (See FIGS. 3 and 4).

Figure 2:
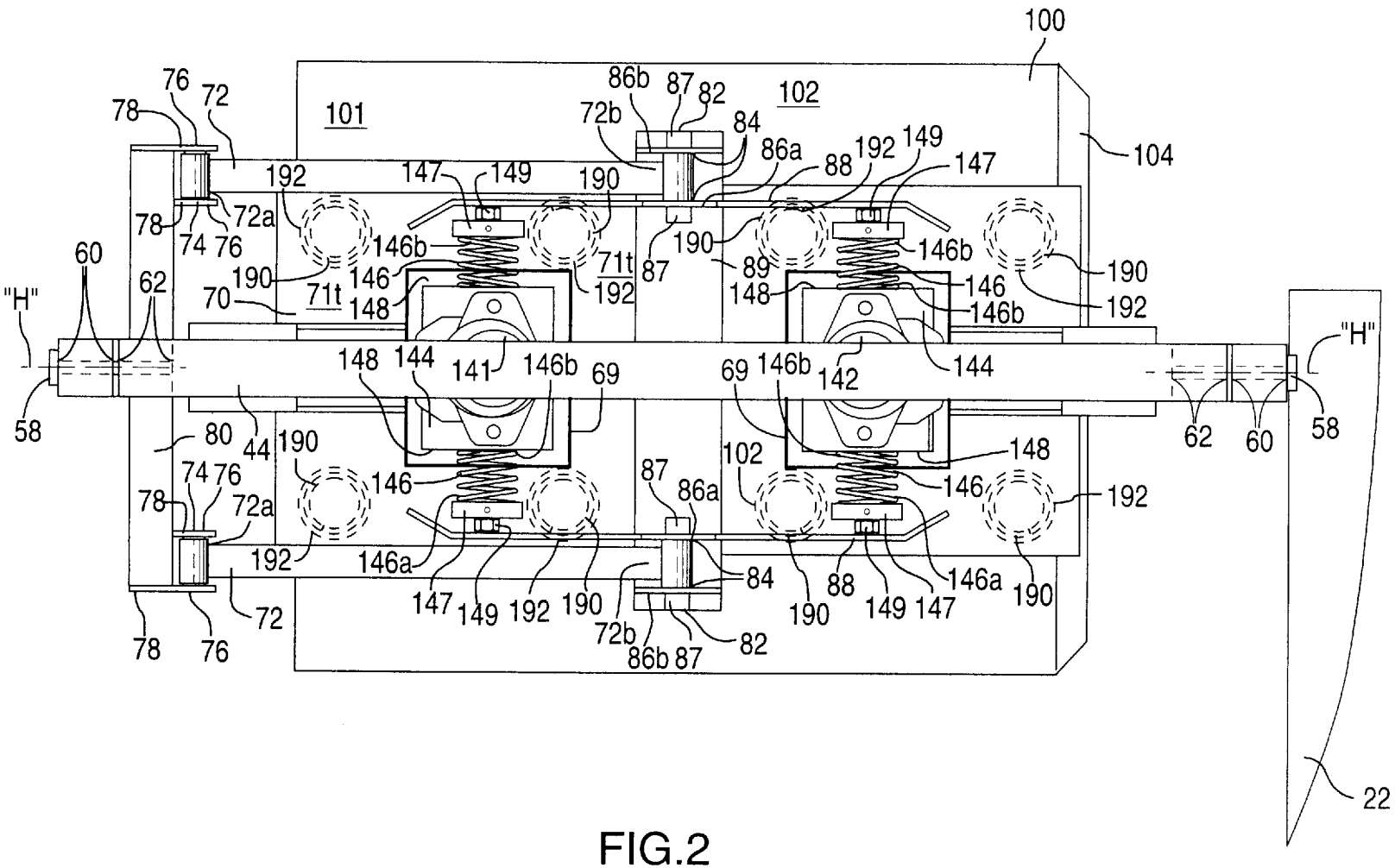
FIG. 2 is a top plan view of the vertically floating head cutter mechanism of FIG. 1.

As can be best seen in FIGS. 2 and 3, horizontally oriented springs 146 are disposed in operative relation between the mounting shroud 100 and each of the frame members 144 for controlling lateral movement of the first 131 and second 132 cutter head assemblies. Specifically, one end 146*a* of the each spring is retained in a cap 147, which cap 147 is adjustably mounted on the vertically and longitudinally disposed mounting plate 88 in adjustable relation by nut 149 threadibly engaged on a cooperating rod (not shown), so as to permit selective compression of the respective spring 146. The opposite other end 146*b* of each spring 146 is intimately engaged against the side 148 of the respective frame member 144.

The drive means further comprises first 151 and second 152 drive shafts operatively rotatably mounted in respective first 153 and second 154 housings affixed to the central deck 102 and connected at their top ends 151*a*, 152*a* to respective propeller shafts 155, 156 of the first 141 and second 142 hydraulic drive motors, each by means of respective releasable couplings 157, 158, for rotation about respective first "G" and second "T" substantially vertical drive axes. In the preferred embodiment, the releasable couplings are Bowex couplings manufactured by Ontario Drive and Gear of New Hamburg, Ontario, Canada, which Bowex releasable couplings allow for about four degrees of axial misalignment between the propeller shafts 155, 156 and the respective drive shafts 151, 152.

Figure 10A:
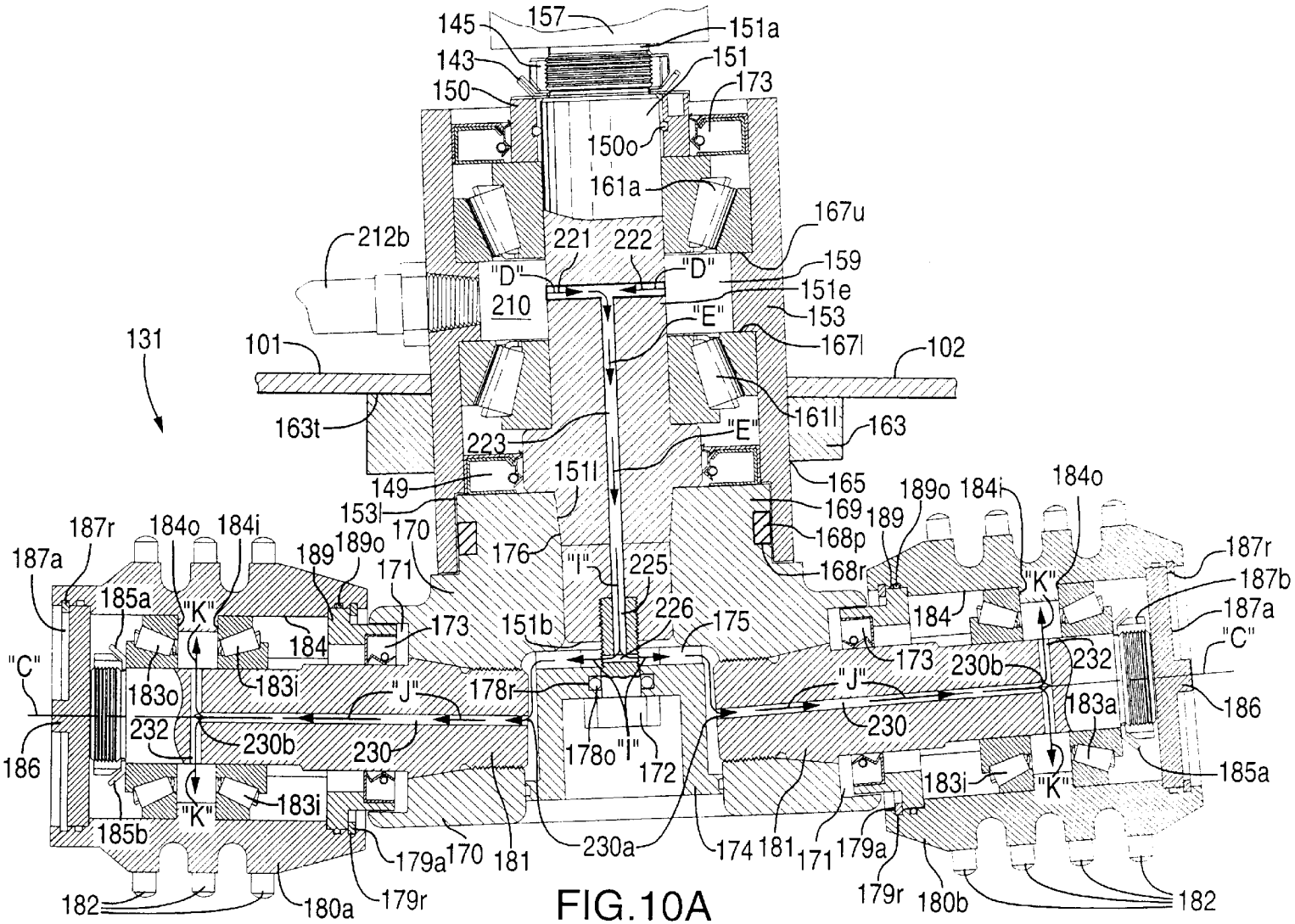
FIG. 10A is an enlarged cross-sectional side elevational view of the front cutter head assembly shown in FIG. 9A.
Figure 10B:
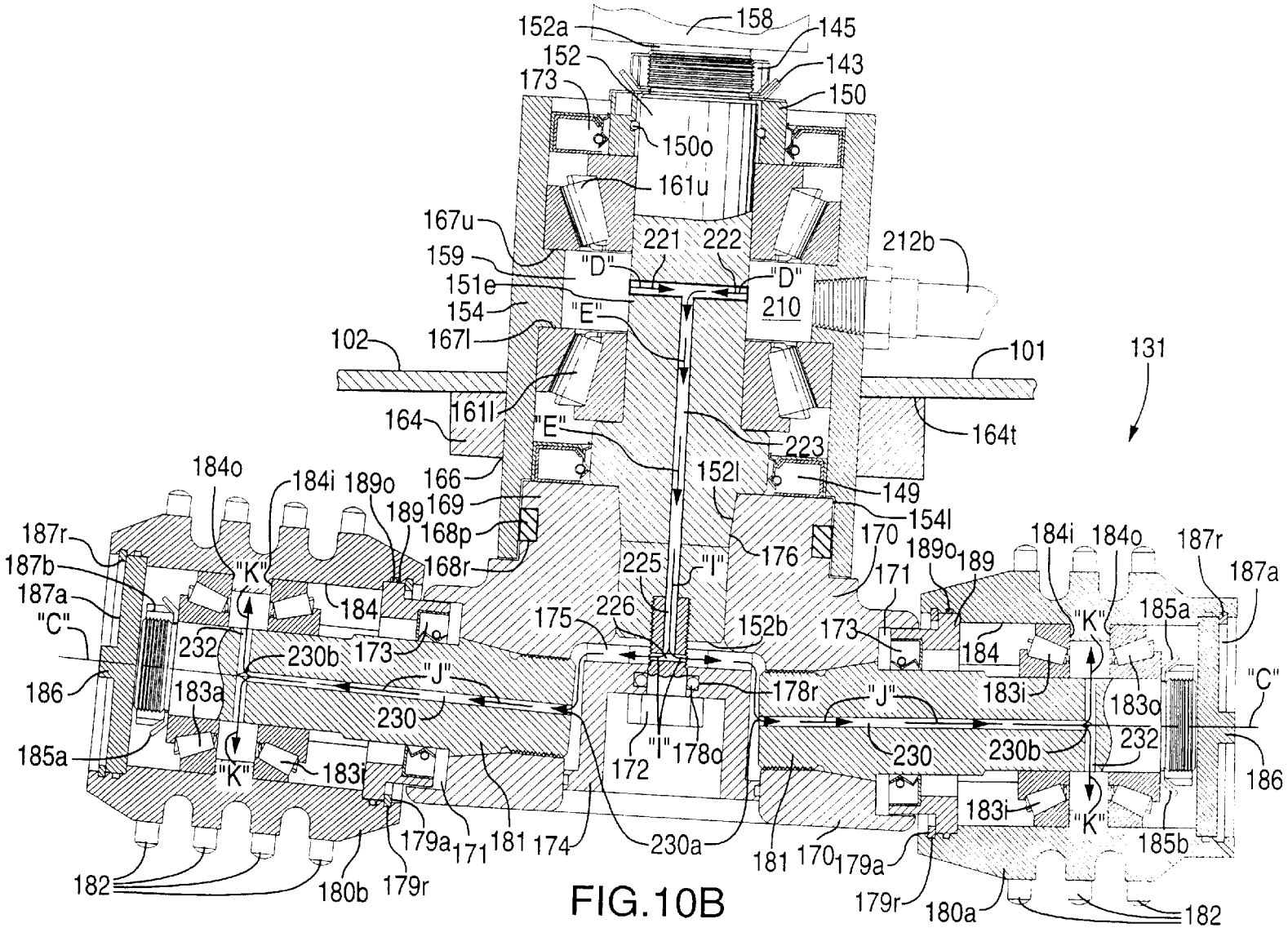
FIG. 10B is an enlarged cross-sectional side elevational view of the rear cutter head assembly shown in FIG. 9A.

As can be best seen in FIGS. 10A and 10B, a portion of the first 151 and second 152 drive shafts are rotationally mounted in substantially centrally disposed bores 159 defined in the first 153 and second 154 housings, respectively, by means of upper 161*u* and lower 161*l* tapered roller bearings mounted within the bores 159 against shoulders 167*u*, and 167*b*, respectively. A collar member 150 frictionally engages each drive shaft 151, 152 with an "O"-ring 150*o* disposed in sealing engagement therebetween. The first 151 and second 152 drive shafts are retained within the first 153 and second 154 housings, respectively, by lock washers 143 and locking nuts 145 intimately engaged in securing relation against the collar member 150. The substantially centrally disposed bores 159 are sealed off at their respective upper ends 159*u* each by a self expanding oil seal 173 is disposed in sealing relation between the collar member 150 and the respective drive shaft 151, 152. In order to preclude backlash of the upper 161*u* and lower 161*l* tapered roller bearings, the locking nuts 145 are preferably hand tightened until snug and are backed off about one quarter turn.

The first 153 and second 154 housings are securely mounted, as aforesaid, on the substantially horizontal central deck 102 by means of first 163 and second 164 annular mounting members, which first 163 and second 164 annular mounting members are preferably welded to the underside of the central deck 102.

The first 163 and second 164 annular mounting members having respective first 165 and second 166 cylindrical passageways with longitudinal axes coincident with the first "G" and second "T" drive axes, respectively, and the first 153 and second 154 housings are rigidly retained in close fitting relation within the first 165 and second 166 cylindrical passageways, respectively.

As can be best seen in FIGS. 9A, 10A, and 10B, the first 163 and second 164 annular mounting members are preferably bevelled at their respective top surfaces 163*t*, 164*t* so as to incline the first cylindrical passageway 165 forwardly and upwardly and incline the second cylindrical passageway 166 rearwardly and upwardly. The first 153 and second 154 housings are thereby angled such that the first "G" and second "T" drive axes are coincident with the first "S" and second "S" axes, respectively. The first "G" and second "T" drive axes are each inclined at an angle of between zero degrees and ten degrees with respect to vertical. In the preferred embodiment, the first "G" and second "T" drive axes are each inclined at an angle of about three degrees with respect to vertical, with the first drive axis "G" being inclined forwardly and upwardly, and the second drive axis "T" being inclined rearwardly and upwardly, as aforesaid.

Each of the first 131 and second 132 cutter head assemblies comprises a base member 170 secured one to each drive shaft 151, 152 by means of a banjo bolt 172 threadibly engaged in the bottom ends 151*b*, 152*b* of the drive shafts 151, 152, for coincident rotation therewith about the respective of the first "G" and second "T" drive axes. An upper annular neck 169 of the base members 170 is seated in the lower end 153*l*, 154*l* of each of the first 153 and second 154 housings, partially within the substantially centrally disposed bores 159. A small clearance between the upper annular neck 169 and the respective first 153 and second 154 housing, and a band of Teflon® packing 168*p* disposed in an annular race 168*r* in the upper annular neck 169, together ensure free rotation of the base member 170 with respect to the respective of the first 153 and second 154 housings.

The substantially centrally disposed bores 159 are sealed off at the respective base member 170 by a self expanding oil seal 149 disposed in sealing relation one between each substantially centrally disposed bore 159 and the respective drive shaft 151, 152.

The banjo bolts 172 also retain in place within a concavity formed in the bottom surface of the base member 170, a cup-shaped plug member 174. The base member 170 and the cup-shaped plug member 174 together define a central chamber 175 within the base member 170. An "O"-ring 178*o* seated within a cooperating annular race 178*r* provides a seal between the banjo bolt 172 and the cup-shaped plug member 174. The first 151 and second 152 drive shafts are operatively connected at their respective tapered lower ends 151*l*, 152*l* into cooperating receiving tapers 176 in the respective base members 170 of the first 131 and second 132 cutter head assemblies, for rotational driving of the cutter head assemblies.

Figure 7:
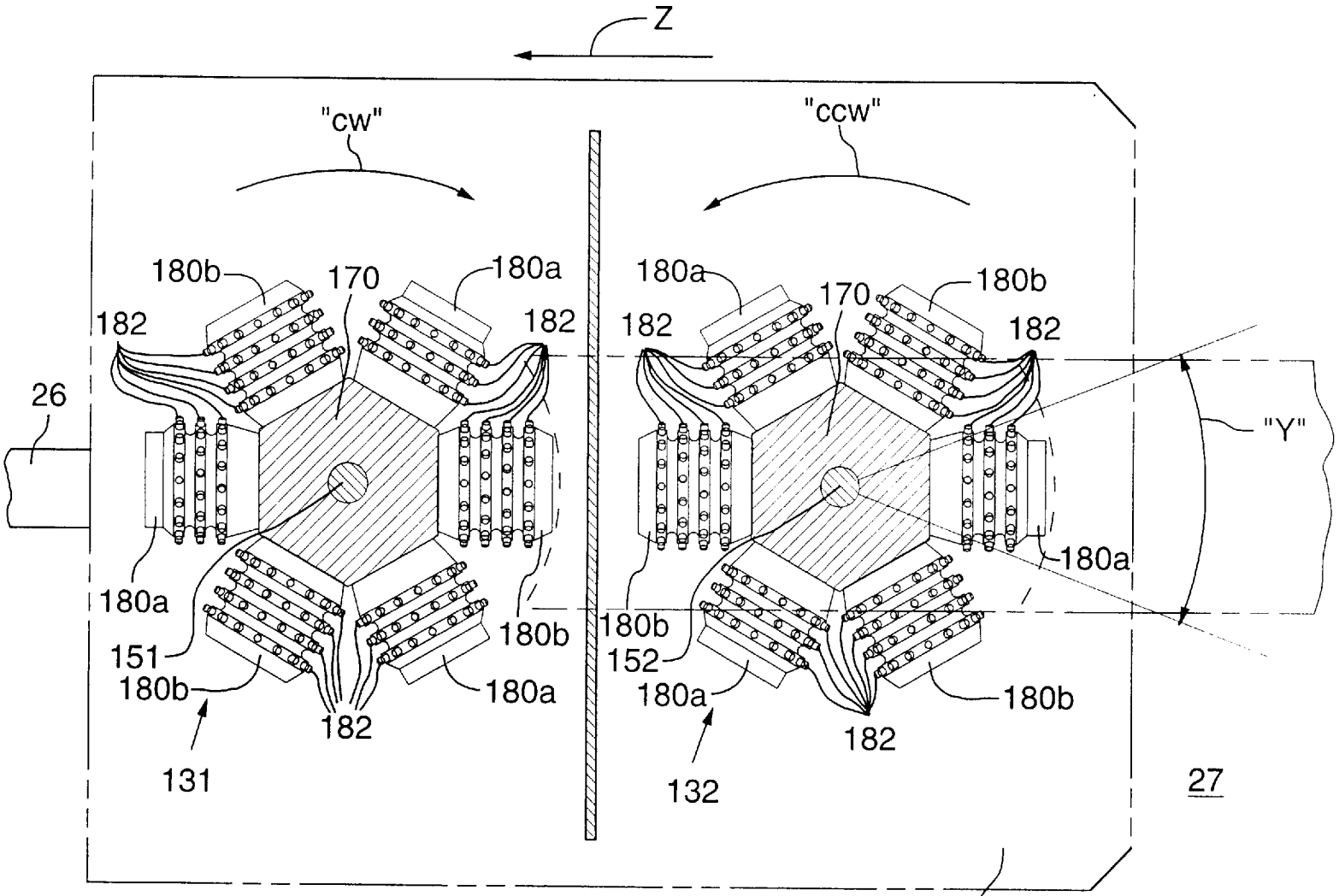
FIG. 7 is a horizontal sectional view of the vertically floating head cutter mechanism of FIG. 1, taken along section line 7—7 of FIG. 9A.
Figure 11A:
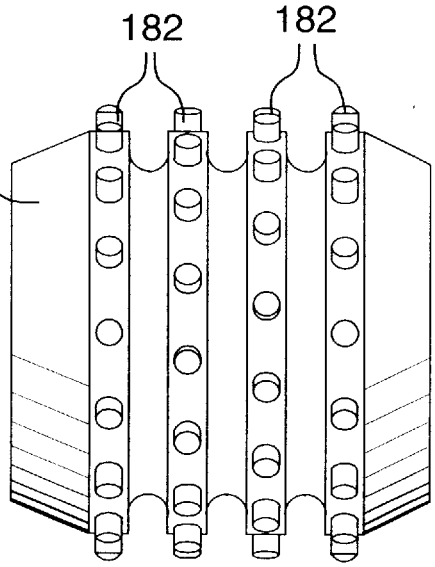
FIG. 11A is an enlarged side elevational view of a cutter head having three spaced apart annular rows of cutting teeth thereon, used on the cutter head assemblies of the vertically floating head cutter mechanism of FIG. 1.
Figure 11B:
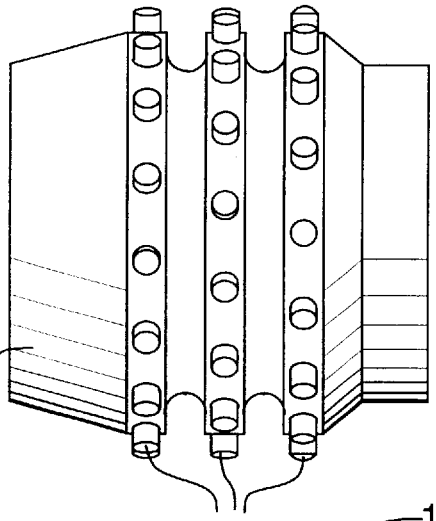
FIG. 11B is an enlarged side elevational view of a cutter head having four spaced apart annular rows of cutting teeth thereon, used on the cutter head assemblies of the vertically floating head cutter mechanism of FIG. 1.
Figure 12A:
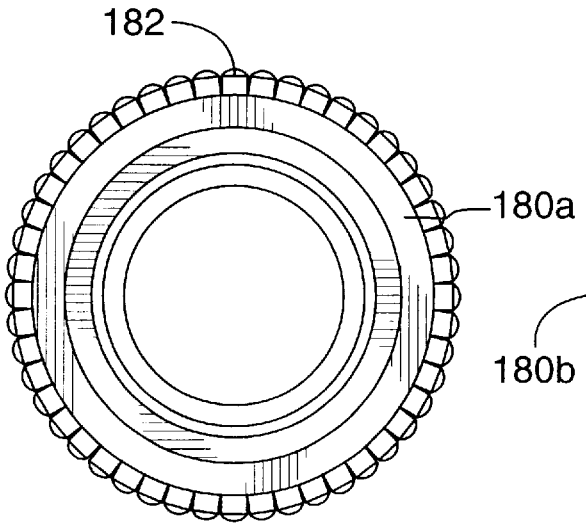
FIG. 12A is an enlarged end elevational view of the cutter head of FIGS. 11A.
Figure 12B:
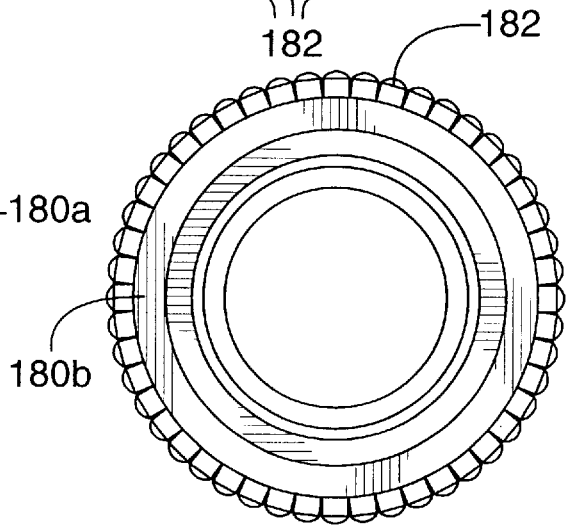
FIG. 12B is an enlarged end elevational view of the cutter head of FIGS. 11B.

As can be best seen in FIG. 7, each of the first 131 and second 132 cutter head assemblies comprises six annular cutter heads 180*a* and 180*b*. The three annular cutter heads 180*a* of each assembly have three spaced apart annular rows of cutting teeth 182, while the three annular cutter heads 180*b* of each assembly have four spaced apart annular rows of cutting teeth 182, disposed in an alternating pattern around the base member 170, as can be best seen in FIGS. 11A and 11B. The rows of teeth 182 are thereby offset in alternating ones of the annular cutter heads 180*a* and 180*b*. In this manner, no grooves or spaces remain when a traffic marking 26 is being removed from a road surface 27. Instead, a substantially smooth cut is made in the road surface 27.

Each of the annular cutter heads 180*a*,180*b* is rotatably mounted on a respective stub axle 181 by means of inner 183*i* and outer 183*o* tapered roller bearings retained in central bores 184 in the respective ones of the annular cutter heads 180*a*,180*b*. The stub axles 181 are threadibly engaged to the base member 170 in substantially evenly spaced radially outwardly projecting relation. The inner 183*i* and outer 183*o* tapered roller bearings are retained in place against shoulders 184*i* and 184*o*, respectively, by a lock washer 185*a* and a lock nut 185*b* threadibly engaged on the respective stub axle to take up the backlash between the outer tapered roller bearing 183*o* and the shoulder 184*o*. Preferably, the stub axles 181 on the first cutter head assembly 131, which rotates clockwise when viewed from the bottom, have right hand threads thereon so that the rotation of the annular cutter heads 180 provides a continuous tightening effect on the respective stub axles 181. Similarly, the stub axles 181 on the second cutter head assembly 131, which rotates counter-clockwise when viewed from the bottom, have left hand threads thereon so that the rotation of the annular cutter heads 180 provides a continuous tightening effect on the respective stub axles 181. Each central bore 184 is closed off at an outer end by an end cap 186 retained in place by a respective "C" clip 187*a* seated in an annular race 187*r*. Similar, a mounting collar 189 and cooperating "O"-ring 189*o* are retained in place at the opposite inner end of each central bore 184 by a "C" clip 179*a* seated in an annular race 179*r*. The mounting collar 189 is received in rotatable relation within a respective cylindrical orifice 171 in the base member 170. A self expanding oil seal 173 is disposed in sealing relation between the mounting collar 189 and the stub axle 181.

The axes of rotation "C" of each of the annular cutter heads 180 of the first 131 and second 132 cutter head assemblies, respectively, are preferably angled upwardly and radially outwardly from the base member 170 at an angle with respect to horizontal, which angle is substantially equal to the angle of inclination of the first and second drive axes. As previously mentioned, this angle is preferably between about zero degrees and ten degrees with respect to vertical, and is optimally about degrees. In this manner, the annular cutter heads 180 intermittently contact the road surface 27 and are lifted from the road surface 27 as the first 131 and second 132 cutter head assemblies rotate. Accordingly, the annular cutter heads 180*a*,180*b* are permitted to rotate between contacts with the road surface 27, even if not during contact with the road surface 27, thus helping to ensure that flat spots do not develop on the cutter head teeth 182. Further, the annular cutter heads 180 are oriented substantially horizontally to the road surface 27 when in contact therewith, in order to facilitate proper cutting.

The vertically floating head cutter mechanism 20 further comprises biasing means indirectly interconnected between the mounting shroud 100 and the vehicle 22, which biasing means comprises at least one spring member 190 disposed in operatively interconnected relation between the mounting shroud 100 and the vehicle 22, to bias the mounting shroud 100 downwardly with respect to the vehicle 22 into cutting engagement with the road surface 27 in at least the operative intermediate position of the mounting shroud 100. In the preferred embodiment, the biasing means comprises an even plurality of spring members 190, specifically eight spring members 190, with each of the eight spring members 190 being mounted in a respective cap member 192 welded to the top surface 101 of the central deck 102 of the mounting shroud 100 and engaging the bottom surface 71*b* of the intermediate platform 70. The eight spring members 190 are thereby operatively interconnected, as aforesaid, preferably in parallel one with another. The eight spring members 190 are held in a slight degree of compression by appropriate dimensioning of the bolt 117 and the robust washer 116 of the vertical guide assemblies 110, so as to keep the eight spring members 190 from coming out of their cap members 192 when the first 131 and second 132 cutter head assemblies are not in engagement with the road surface 27, which corresponds to the intermediate platform 70 being in its upper zone of non-engagement positions, as there is then no upwardly directed external force applied to the first 131 and second 132 cutter head assemblies. Once the intermediate platform 70 has been lowered from its upper zone of non-engagement positions to its lower zone of engagement positions, the first 131 and second 132 cutter head assemblies are resiliently urged into cutting engagement with the road surface 27. Accordingly, the eight spring members 190 are compressed by the weight of the vertically floating head cutter mechanism 20 to a preferable force of about seventy five pounds each, for a total downward force on the mounting shroud 100 of about six hundred pounds. Since the weight of the vertically floating head cutter mechanism 20 is essentially offset by the two lifting springs 90, the downwardly directed force of the cutter heads 180 on the road surface 27 is about six hundred pounds.

Each of the eight spring members 190 is preferably a progressive rate coil spring designed to keep a substantially constant downwardly directed force on the mounting shroud 100, over a vertical travel of about one half inch up and about one half inch down of the mounting shroud 100 with respect to the intermediate platform 70. Accordingly, the eight progressive rate coil springs 190 are adapted for biasing the mounting shroud 100 towards the lower limit position, and for resiliently urging the first 131 and second 132 cutter head assemblies into cutting engagement with the road surface 27 through the open bottom 106 of the mounting shroud 100, with a substantially constant cutting force applied by each of the first 131 and second 132 cutter head assemblies to the road surface 27 irrespective of irregularities encountered in the road surface 27 as the vehicle 22 moves therealong.

The biasing means additionally comprises at least one hydraulically actuated cylinder 200 operatively interconnected in an indirect manner between the vehicle 22 and the mounting shroud 100. Specifically, in the preferred embodiment, the at least one hydraulically actuated cylinder comprises two hydraulically actuated cylinders 200 each interconnected at one end 200*a* to the inverted "U"-shaped pivoting member 48 of the mounting frame 40 and connected at the opposite other end 200*b* to respective mounting collars 202 on the downwardly open channel-shaped extensions 94 of the intermediate platform 70. The two hydraulically actuated cylinders 200 produce, by hydraulic pressure, an output force proportional to the hydraulic pressure and directed onto the mounting shroud 100 to downwardly bias the mounting shroud 100 with respect to the vehicle 22 into cutting engagement with the road surface 27. The two hydraulically actuated cylinders 200 direct their output force indirectly onto the mounting shroud 100 through the eight spring members 190, which eight spring members 190 are, as previously described, each mounted between the intermediate platform 70 and the mounting shroud 100. The output force is selectably actuatable by means of a directional valve 204 and is selectively adjustable by means of an absolute pressure control valve 206 (see FIG. 1). The input of the directional valve 204 is operatively connected in fluid communication (by hydraulic line 34') to the fourth hydraulic motor 34. The input of the absolute pressure control valve 206 is from the directional valve 204 and the output of the absolute pressure control valve 206 is operatively connected in fluid communication (by hydraulic lines 206') to both of the two hydraulically actuated cylinders 200 to allow for selective control of the hydraulic pressure in the two hydraulically actuated cylinders 200.

The directional valve 204 is used by the operator to selectively control the vertical position of the vertically floating head cutter mechanism 20, and thus control the engagement of the first 131 and second 132 cutter head assemblies with the road surface 27, by raising and lowering the intermediate platform 70 between its lower zone of engagement positions and an upper zone of non-engagement positions. In use, when it is required to initially place the first 131 and second 132 cutter head assemblies into cutting engagement with the road surface 27, a control lever 205 on the directional valve 204 is manually manipulated by the operator to direct hydraulic pressure to the two hydraulically actuated cylinders 200 in order to lower the vertically floating head cutter mechanism 20, against the upwardly directed force of the lifting springs 20, so as to bias the mounting shroud 100 towards the lower limit position and so as to resiliently urge the first 131 and second 132 cutter head assemblies into cutting engagement with the road surface 27.

Once the first 131 and second 132 cutter head assemblies are lowered into cutting engagement with the road surface 27, the desired cutting pressure may be selected by the operator. A control lever 207 on the absolute pressure control valve 206 is manually manipulated by the operator to set the hydraulic pressure in the two hydraulically actuated cylinders 200, to thereby set the downwardly directed force of the cutter heads 180*a*,180*b* on the road surface 27 in order to achieve a desired depth of cut. Further, the absolute pressure control valve 206 is adapted to maintain the operator selected hydraulic pressure within the hydraulically actuated cylinders 200 at a substantially constant value. Accordingly, the hydraulically actuated cylinders 200 maintain a substantially constant downwardly directed force on the mounting shroud 100, so as to resiliently urge the first 131 and second 132 cutter head assemblies into cutting engagement with the road surface 27 with a substantially constant cutting force irrespective of irregularities encountered in the road surface 27 as the vehicle 22 moves therealong, and without operator intervention. Thus, there is maintained a substantially constant downwardly directed force by the first 131 and second 132 cutter head assemblies onto the road surface 27, when the cutter heads 180 engage the road surface 27, to thereby achieve a substantially constant cutting depth. In the preferred embodiment, the absolute pressure control valve 206 is manufactured by Sunstran Industries of Toronto, Ontario Canada.

When it is required to remove the first 131 and second 132 cutter head assemblies from engagement with the road surface 27, such as between removal of traffic markings 26, the control lever 205 on the directional valve 204 is manually manipulated by the operator to divert hydraulic pressure from the hydraulically actuated cylinders 200, thus causing the hydraulically actuated cylinders 200 to shorten. Accordingly, the two lifting springs 90 lift the intermediate platform 70 from its lower zone of engagement positions to its upper zone of non-engagement positions, and thereby lift the vertically floating head cutter mechanism 20, as indicated by arrows "L" in FIG. 4, such that the first 131 and second 132 cutter head assemblies are removed from engagement with the road surface 27. The vehicle 22 can then be moved without cutting the road surface 27. Once the vehicle 22 is again in place for removing a traffic marking 26, the control lever 205 on the directional valve 204 is manually manipulated by the operator to direct hydraulic pressure to the hydraulically actuated cylinders 200 to automatically return to its selected level, thus lengthening the cylinder 200 to again resiliently urge the first 131 and second 132 cutter head assemblies into cutting engagement with the road surface 27 with a substantially constant cutting force. In this manner, it will be appreciated that it is not necessary to reselect the previously selected downwardly directed force applied by the first 131 and second 132 cutter head assemblies to the a road surface 27.

Another problem addressed by the present invention is that of lubrication and cooling of the drive shafts 151, 152 and cutter heads 180*a* and 180*b*. The generally centrally disposed bores 159 of the first 153 and second 154 housings are each adapted to contain a bath of lubricant 210 for lubrication of an exterior portion 151*e*, 152*e* of each of the first 151 and second 152 drive shafts and the upper 161*u* and lower 161*l* tapered roller bearings. Lubricant 210 placed in the bores 159 is supplied by the remote lubricant reservoir 89 disposed on the central deck 102 of the mounting shroud 100, and is gravity fed through two supply hoses 212*a*, 212*b* connected in fluid communication to the remote lubricant reservoir 89 through a "T" fitting 214. The first 151 and second 152 drive shafts each have radial passageways 221, 222 extending in fluid communication between the exterior portion 151*e*, 152*e* of the respective drive shaft 151, 152 and an axially disposed longitudinal passageway 223 within the respective drive shaft 151, 152. The banjo bolts 172 also each have an axially disposed longitudinal passageway 225 in fluid communication with radial passageways 226. When the banjo bolts 172 are in place in each of the drive shafts 151, 152, their axially disposed longitudinal passageway 225 is in fluid communication with the axially disposed longitudinal passageway 223 of the respective first 151 and second 152 drive shaft, and the radial passageways 226 of the banjo bolts are in fluid communication with the central chamber 175 in the base member 170. In this manner, the generally centrally disposed bores 159 of the first 153 and second 154 housings are connected in fluid communication with the central chamber 175 in the base member 170 of the respective cutter head assembly 131, 132.

Also, the stub axles 181 of each of the first 131 and second 132 cutter head assemblies each have an axially disposed longitudinal passageway 230 in fluid communication at a proximal end 230*a* thereof with the central chamber 175 in the base member 170 of the respective cutter head assembly 131, 132, and in fluid communication at an opposite distal end 230*b* with one or more radial passageways 232, which radial passageways 232 are in fluid communication with a the central bore 184 in the respective annular cutter head 180, so as to provide for passage of the lubricant 210 to the inner 183*i* and outer 183*o* tapered roller bearings of the respective annular cutter head 180. As can be best seen in FIGS. 10A and 10B, the lubricant flows from the generally centrally disposed bores 159 of the first 153 and second 154 housings into the respective radial passageway 221, 222, as indicated by arrows "D"; flows into and through the respective axially disposed longitudinal passageway 223, as indicated by arrows "E"; flows through the axially disposed longitudinal passageway 225 and the radial passageways 226 of the banjo bolt 172, and into the central chamber 175 of the respective base member 170, as indicated by arrows "I"; flows into and through the central bores 184 in the cutter heads 180, as indicated by arrows "J"; and flows into and through the radial passageways 232, so as to be introduced into the central bore 184 in the respective annular cutter head 180, as indicated by arrows "K", thus lubricating the cutter head assemblies 131, 132, especially the inner 183*i* and outer 183*o* tapered roller bearings. It has been found in using the preferred embodiment vertically floating head cutter mechanism 20 having lubricated first 131 and second 132 cutter head assemblies as taught herein, that the upper 161*u* and lower 161*l* tapered roller bearings and the inner 183*i* and outer 183*o* tapered roller bearings are kept at an operating temperature in the order of 100 degrees F., in contrast the-various bearings with prior art traffic marking removers, which bearings operate at temperatures in the order of 350 degrees F.

In addition to being gravity fed, the centrifugal force created by the rotation of each of the first 131 and second 132 cutter head assemblies helps draw the lubricant to the inner 183*i* and outer 183*o* tapered roller bearings, and also to the end caps 186, thus precluding dust from entering into the central bores 184 of the cutter heads 180.

As can be appreciated by those skilled in the art, removal of traffic markings 26 from road surfaces such as road surface 27, by the vertically floating head cutter mechanism 20 of the present invention, as described herein, requires a substantial amount of cutting force applied by the cutter heads 180. Accordingly, the cutter heads 180 tend to wear, although much less frequently than with prior art traffic marking removers, and may even break occasionally. Also, the various bearings are subjected to considerable loads and may require periodic replacement, although less frequently than with prior art traffic marking removers. It is preferable to perform maintenance on location and as quickly as possible, in order to minimize unproductive "down time". It can therefore be seen that the mounting frame 40, having an inverted "U"-shaped stationary member 42 rigidly secured to the vehicle 22 and a substantially congruent inverted "U"-shaped pivoting member 48 mounted in pivotal relation within the stationary member 42 for selective pivotal movement between an in-use configuration and access configuration, as indicated by arrow "N" as described above, permits ready access to the open bottom 106 of the mounting shroud 100 and to the first 131 and second 132 cutter head assemblies when in the rotated access configuration, in the event that Maintenance must be performed to the cutter head assemblies 131, 132. It is first necessary to lift the intermediate platform 70 from its lower zone of engagement positions to its upper zone of non-engagement positions, and thereby lifting the vertically floating head cutter mechanism 20 from its lowered in-use position to its raised inoperative position, as indicated by arrows "L" in FIG. 4, before rotating the pivoting member 48 from its in-use configuration to its access configuration.

Figure 8:
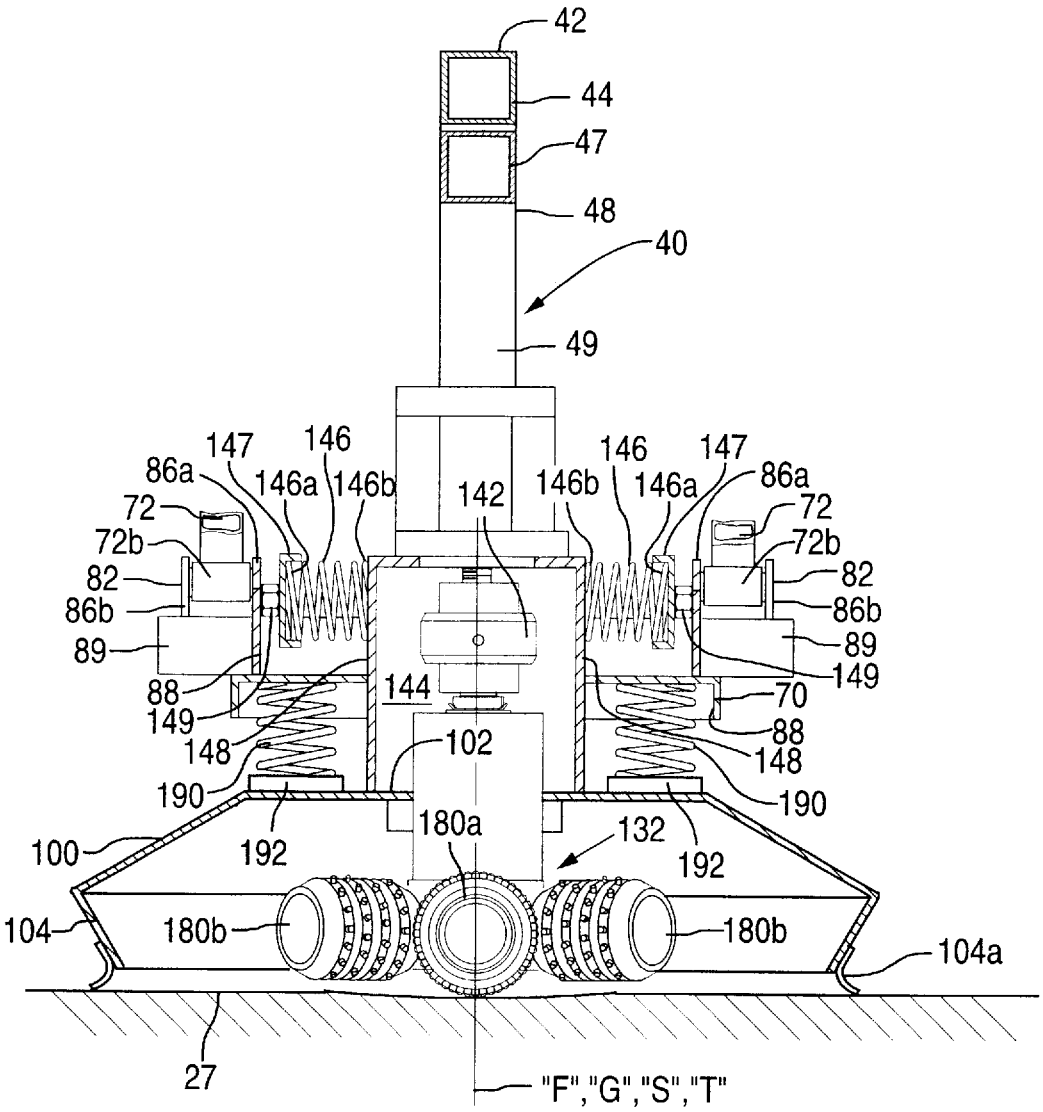
FIG. 8 is a vertical sectional view of the vertically floating head cutter mechanism of FIG. 1, taken along section line 8—8 of FIG. 3.
Figure 13A:
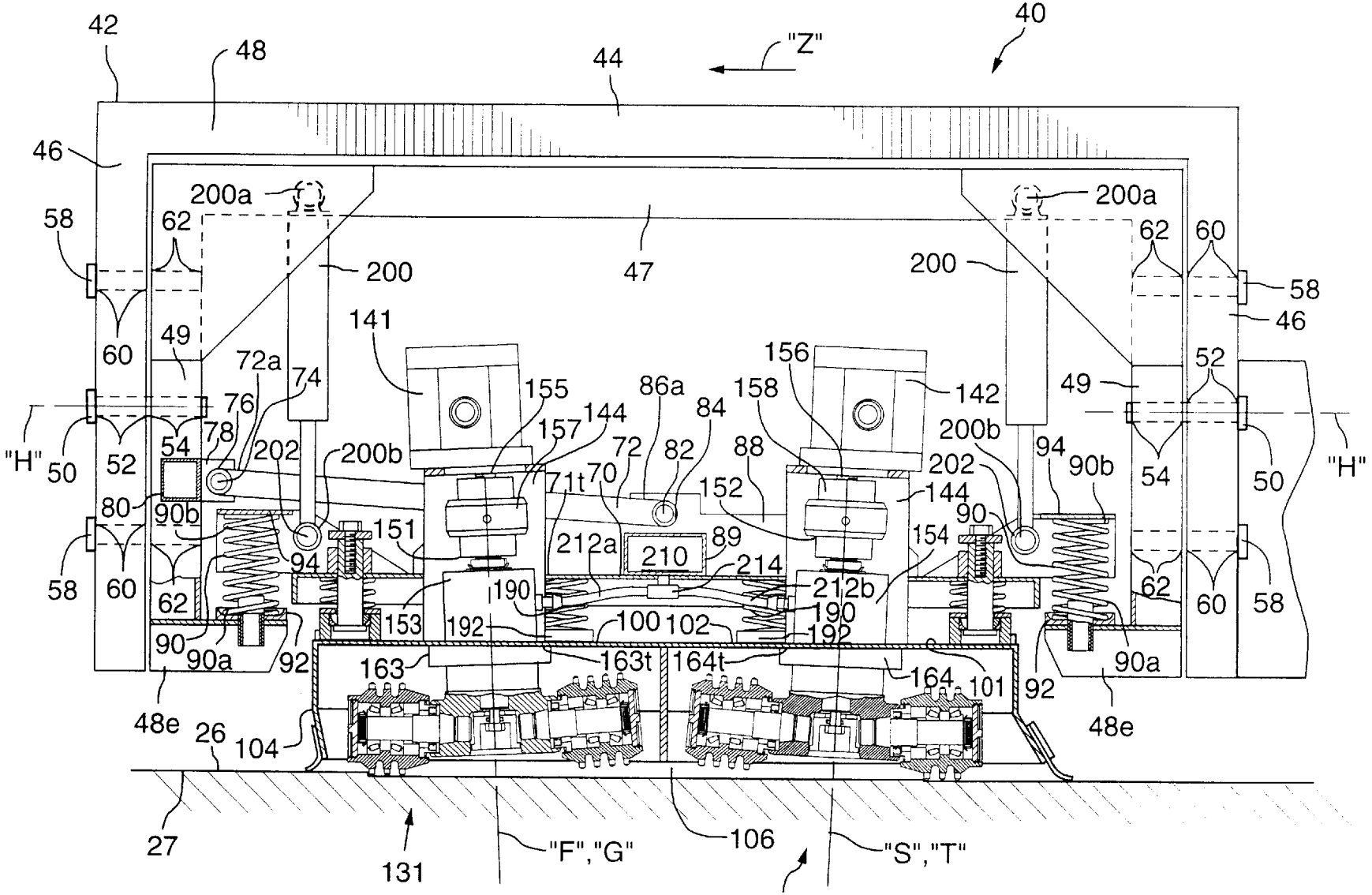
FIG. 13A is a view similar to FIG. 9A, with the cutter heads removing a traffic marking from a substantially flat road surface.

Reference will now be made to FIGS. 7A and 13A through 13F of the drawings to show the vertical movement of the vertically floating head cutter mechanism 20 as the vehicle 22 moves in a direction as indicated by arrows "Z". Referring now to FIGS. 7 and 13A of the drawings, it can be seen that as the first 131 and second 132 cutter head assemblies rotate, the cutter heads 180*a*,180*b* come down from a slightly lifted position to contact and cut the road surface 27. On the first cutter head assembly 131 the cutter head 180*a* that is disposed adjacent the front of the mounting shroud 100 first contacts the road surface 27. Similarly, on the second cutter head assembly 131 the cutter head 180*a* that is disposed adjacent the rear of the mounting shroud 100 contacts the road surface 27. The cutter heads 180*a*,180*b* mounted on the first cutter head assembly 131 cut a groove to a partial depth, and the cutter heads 180*a*,180*b* mounted on the second cutter head assembly 131 cut more deeply so as to cut the desired depth of groove, and so as to completely remove the traffic marking 26 from the road surface 27. Due to the angles of inclination of the first axis "F" and the second axis "S", the cutter heads 180 contact the road surface 27 at a limited cutting sector only, as indicated by arrow "Y" in FIG. 7. In this manner, a shallowly curved groove is cut, which groove has a width of about twelve to fifteen inches, having no substantially transverse side edges, as can be best seen in FIGS. 7 and 8.

Figure 13B:
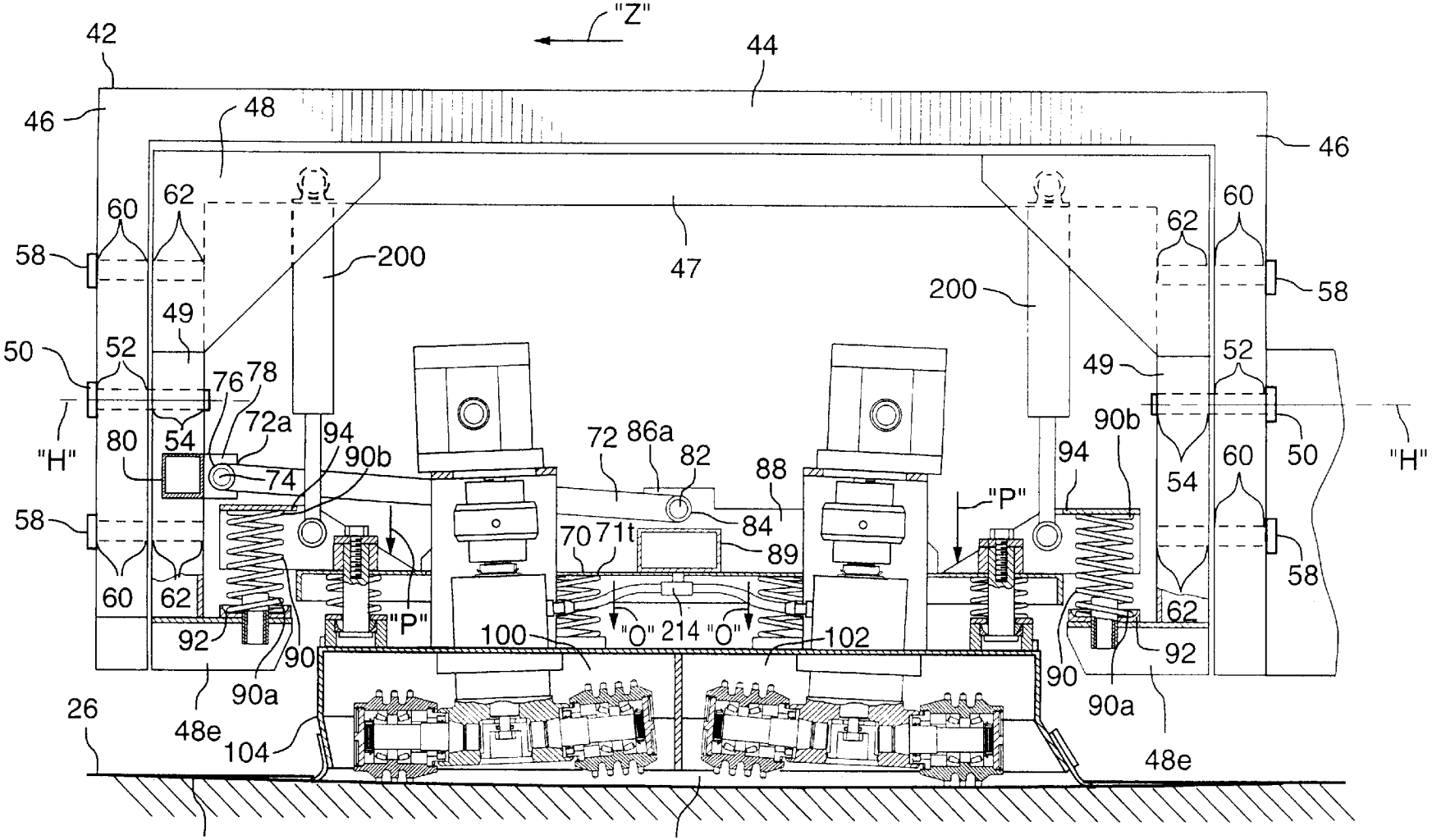
FIG. 13B is a view similar to FIG. 13A, with the cutter heads removing a traffic marking from a road surface having a shallow depression therein.

If the road surface 27 has a slight depression therein, as can be best seen in FIG. 13B, the eight spring members 190 extend slightly, as indicated by arrows "O", so as to permit the mounting shroud 100 to move downwardly from its operative intermediate position to its lower limit position, all the while resiliently urging the first 131 and second 132 cutter head assemblies into cutting engagement with the road surface 27 with a substantially constant cutting force. At its lower limit position, the aforesaid gap between the robust washer 116 and the top end 112*a* of the vertically oriented shaft 112 of the two vertical guide assemblies 110, disappears, as indicated by arrows "P". Accordingly, the eight spring members 190 cannot extend further.

Figure 13C:
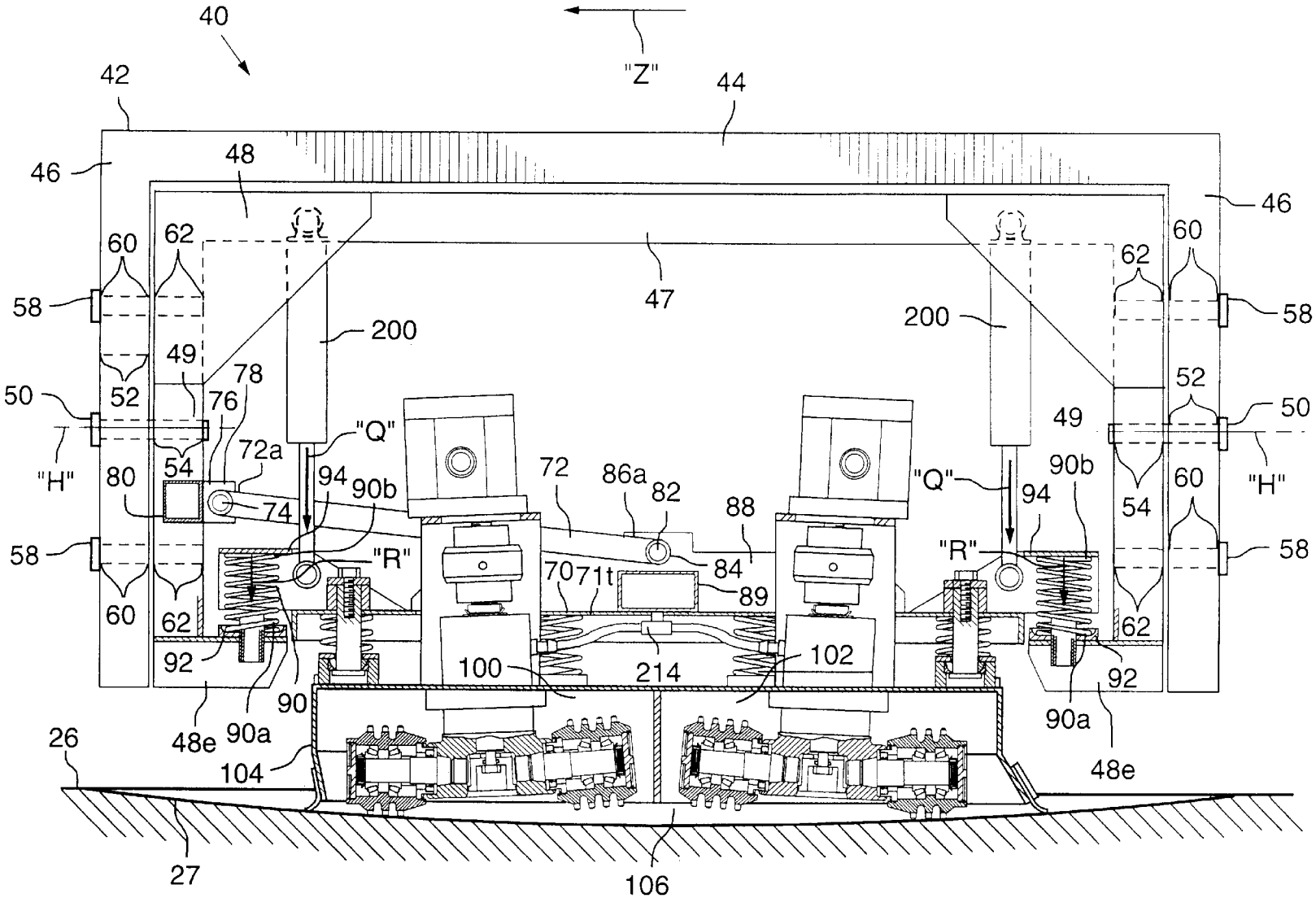
FIG. 13C is a view similar to FIG. 13A, with the cutter heads removing a traffic marking from a road surface having a deeper depression therein than shown in FIG. 13B.

If the road surface 27 has a greater depression therein, as can be best seen in FIG. 13C, the hydraulically actuated cylinders 200 are lengthened, as indicated by arrows "Q", and the two lifting springs 90 are further compressed, as indicated by arrows "R", by the pulling of the intermediate platform 70, so as to permit the intermediate platform 70 to move to a lower position in its lower zone of engagement positions. The lengthening of the hydraulically actuated cylinders 200 correspondingly decreases the hydraulic pressure in the hydraulically actuated cylinders 200. Accordingly, the absolute pressure control valve 206 compensates for the decreased hydraulic pressure and continuously increases the hydraulic pressure back to the operator selected value, thus maintaining the hydraulic pressure in the hydraulically actuated cylinders 200 at a substantially constant value. The mounting shroud 100 is retained in its lower limit position, and the first 131 and second 132 cutter head assemblies are resiliently urged into cutting engagement with the road surface 27 with a substantially constant cutting force.

Figure 13D:
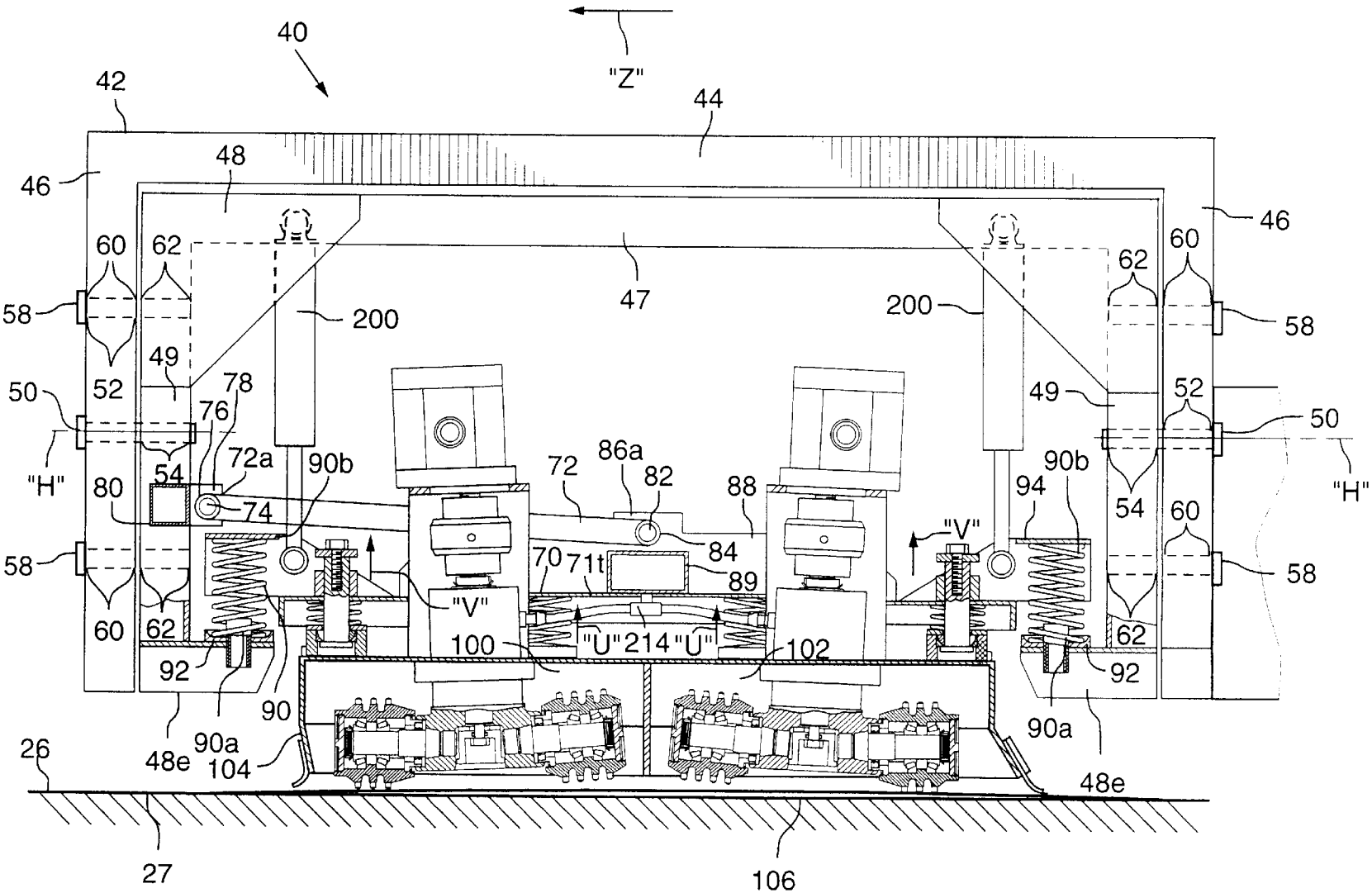
FIG. 13D is a view similar to FIG. 13A, with the cutter heads removing a traffic marking from a road surface having a shallow rise thereon.

If the road surface 27 has a slight rise therein, as can be best seen in FIG. 13D, the eight spring members 190 compress slightly, as indicated by arrows "U", so as to permit the mounting shroud 100 to move upwardly from its operative intermediate position to its upper limit position, all the while resiliently urging the first 131 and second 132 cutter head assemblies into cutting engagement with the road surface 27 with a substantially constant cutting force. At its upper limit position, the aforesaid gap between the robust washer 116 and the top end 112*a* of the vertically oriented shaft 112 of the two vertical guide assemblies 110 increases in size, as indicated by arrows "V", until the eight spring members 190 cannot compress further.

Figure 13E:
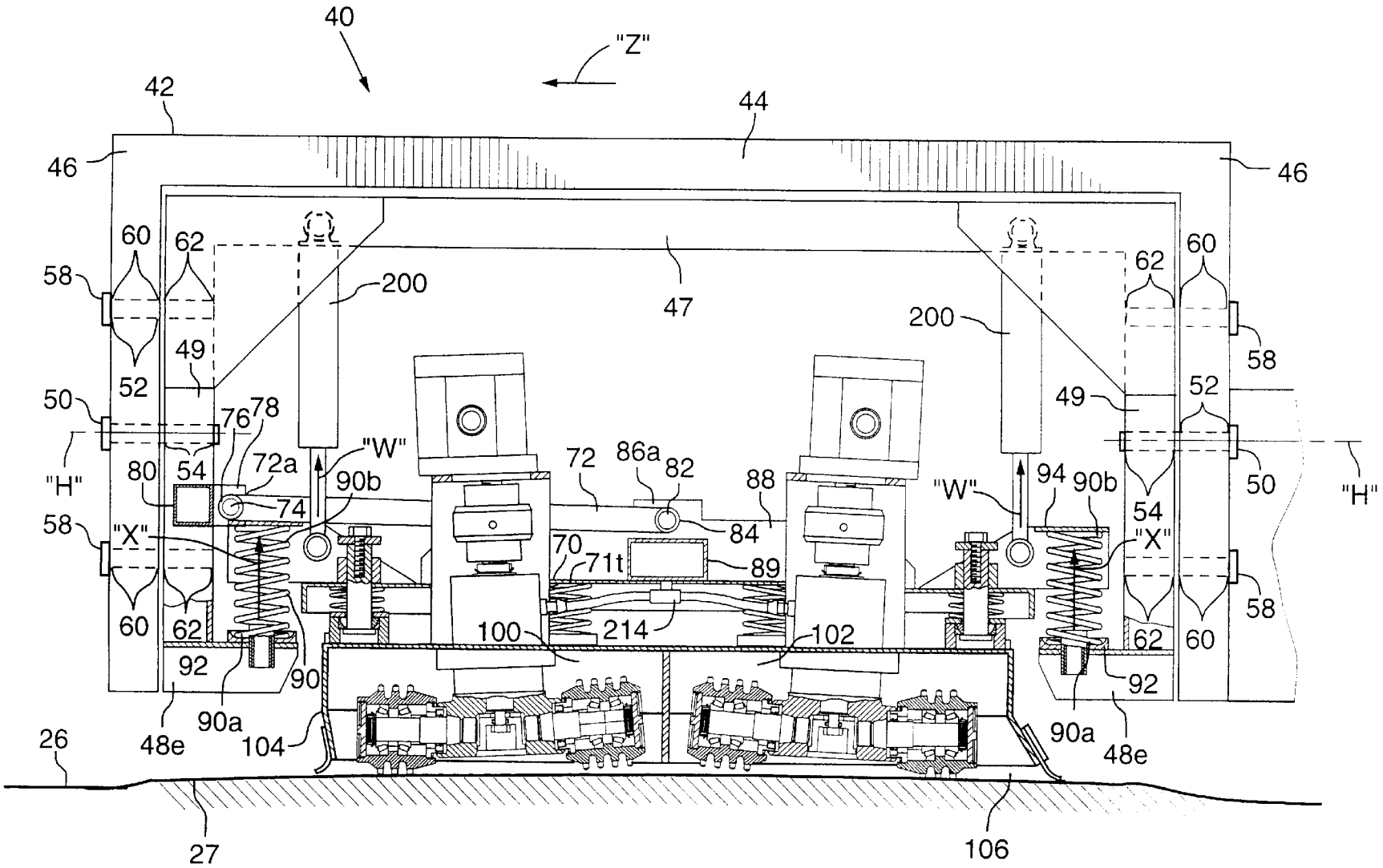
FIG. 13E is a view similar to FIG. 13A, with the cutter heads removing a traffic marking from a road surface having a deeper rise thereon than shown in FIG. 13D; and, FIG. 13F is a view similar to FIG. 13A, with the cutter heads removing a traffic marking from a road surface having an irregular surface.

If the road surface 27 has a greater rise therein, as can be best seen in FIG. 13E, the hydraulically actuated cylinders 200 are shortened, as indicated by arrows "W", and the two lifting springs 90 are extended, as indicated by arrows "X", by the pushing of the intermediate platform 70, so as to permit the intermediate platform 70 to move to a higher position in its lower zone of engagement positions. The shortening of the hydraulically actuated cylinders 200 correspondingly increases the hydraulic pressure in the hydraulically actuated cylinders 200. Accordingly, the absolute pressure control valve 206 compensates for the increased hydraulic pressure and continuously decreases the hydraulic pressure back to the operator selected value, thus maintaining the hydraulic pressure in the hydraulically actuated cylinders 200 at a substantially constant value. Accordingly, the mounting shroud 100 is retained in its upper limit position, and the first 131 and second 132 cutter head assemblies are resiliently urged into cutting engagement with the road surface 27 with a substantially constant cutting force.

Figure 13F:
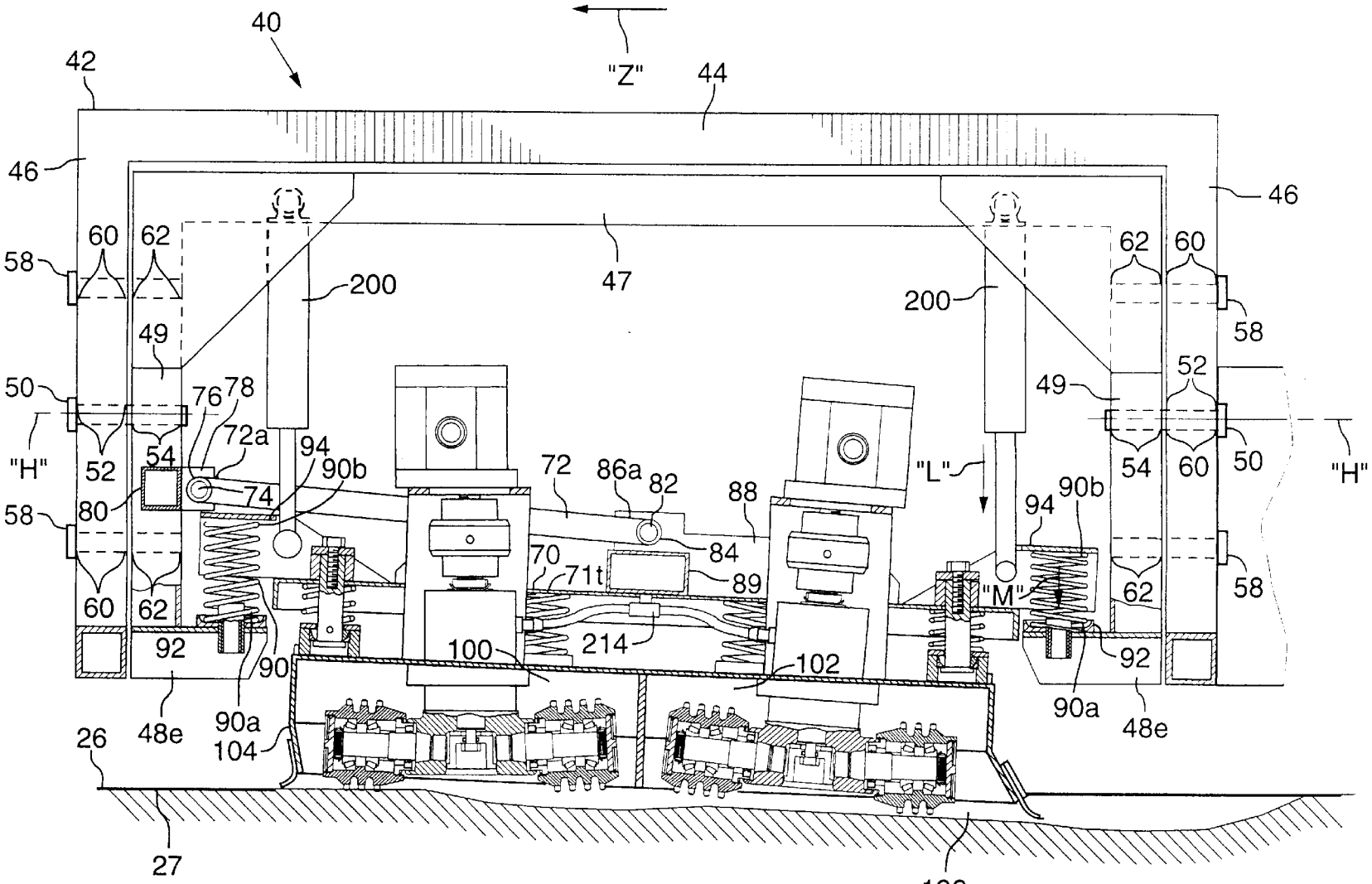

FIG. 13F illustrates that the first 131 and second 132 cutter head assemblies can independently follow an uneven road surface whilst maintaining a substantially constant cutting force. As illustrated, the second cutter head assembly 132 has lowered by a significant distance, perhaps about two inches. Accordingly, only one of the hydraulically actuated cylinders 200 has extended, as indicated by arrow "L" and only one of the lifting springs 90 has compressed, as indicated by arrow "M", thus compensating for the uneven movement.

It has been found with the preferred embodiment vertically floating head cutter mechanism 20 that a rotational speed of the first 131 and second 132 cutter head assemblies of about 1800 r.p.m. can be consistently achieved, which rotational speed is far superior to that achieved by prior art machines. Also, it has been found that a travelling speed of about two kilometers per hour can be readily sustained, which travelling speed is about ten to twenty times faster than prior art machines, and that a closely controlled cutting path can be followed at that speed. Further, the preferred embodiment vertically floating head cutter mechanism 20 produces a cut without substantially vertical sides and having an almost unvarying central depth of between five and eight millimeters, which is not possible with prior art traffic marking removers.

Other modifications and alterations may be used in the design and manufacture of the apparatus of the present invention without departing from the spirit and scope of the invention as set out in the accompanying claims.

We claim:

1. A vehicle having three or more wheels, supporting substantially all of the vehicle weight on said wheels, for removing a traffic marking from a road surface, and having a vertically floating head cutter mechanism comprising:

a mounting shroud having an open bottom and being suspended from said vehicle in substantially vertically movable relation with respect to said vehicle by two or more vertical guide means, which vertical guide means define upper and lower limits of vertical travel of said mounting shroud and are dimensioned and otherwise adapted to locate said mounting shroud in an operative intermediate position between said upper and lower limit positions;

first and second cutter head assemblies operatively mounted within said mounting shroud adjacent said open bottom for counter-rotation about respective first and second axes;

drive means operatively connected to said first and second cutter head assemblies for causing said counter-rotation thereof;

biasing means interconnected between said mounting shroud and said vehicle for biasing said mounting shroud towards said lower limit position and for resiliently urging said first and second cutter head assemblies into cutting engagement with said road surface through the open bottom of the mounting shroud, with a substantially constant cutting force applied by each cutter head assembly to the road surface irrespective of irregularities encountered in said road surface as said vehicle moves therealong.

2. The vertically floating head cutter mechanism of claim 1, wherein said biasing means comprises at least one spring member disposed in operatively interconnected relation between said mounting shroud and said vehicle to bias said mounting shroud downwardly with respect to said vehicle into said cutting engagement with said road surface in at least said operative intermediate position.

3. The vertically floating head cutter mechanism of claim 2, wherein said biasing means comprises an even plurality of spring members each operatively interconnected as aforesaid, in parallel one with another.

4. The vertically floating head cutter mechanism of claim 3, wherein each of said even plurality of spring members are progressive rate coil springs.

5. The vertically floating head cutter mechanism of claim 4, wherein said biasing means additionally comprises a hydraulically actuated cylinder operatively interconnected between said vehicle and said mounting shroud to produce by hydraulic pressure an output force proportional to said hydraulic pressure and directed onto said mounting shroud to downwardly bias said mounting shroud with respect to said vehicle into said cutting engagement with said road surface.

6. The vertically floating head cutter mechanism of claim 5, wherein said output force is adjustable by means of a directional valve operatively connected in fluid communication to said hydraulically actuated cylinder for selecting contraction or extension of said hydraulic cylinder.

7. The vertically floating head cutter mechanism of claim 6, further comprising an automatic pressure control operatively connected in fluid communication to said directional valve and being adapted to maintain said hydraulic pressure at a substantially constant value.

8. The vertically floating head cutter mechanism of claim 7, further comprising an intermediate platform mounted in suspended relation between said vehicle and said mounting shroud for substantially vertical movement between a lower zone of engagement positions and an upper zone of non-engagement positions, and wherein said vertical guide means are operatively interconnected between said intermediate platform and said mounting shroud.

9. The vertically floating head cutter mechanism of claim 8, wherein said hydraulically actuated cylinder is operatively interconnected, as aforesaid, between said vehicle and said intermediate platform so as to direct said output force onto said mounting shroud through said even plurality of spring members, which even plurality of spring members are each mounted between said intermediate platform and said mounting shroud.

10. The vertically floating head cutter mechanism of claim 9, further comprising at least one lifting spring operatively disposed between said vehicle and said intermediate platform to assist in lifting said intermediate platform from said lower zone of engagement positions toward said upper zone of non-engagement positions.

11. The vertically floating head cutter mechanism of claim 10, wherein said vertical guide means are dimensioned and otherwise adapted to accommodate about four inches of said vertical travel of said mounting shroud.

12. The vertically floating head cutter mechanism of claim 11, wherein said vertical guide means additionally comprises a spherical plane bearing to accommodate limited angular movement of said mounting shroud with respect to said intermediate platform.

13. The vertically floating head cutter mechanism of claim 10, wherein said mounting shroud comprises a substantially horizontal central deck and a skirt portion depending therefrom.

14. The vertically floating head cutter mechanism of claim 13, wherein said drive means comprises first and second hydraulic drive motors each mounted above said central deck.

15. The vertically floating head cutter mechanism of claim 14, wherein said first and second hydraulic drive motors are each mounted on a frame member substantially directly above said first and second cutter head assemblies, respectively.

16. The vertically floating head cutter mechanism of claim 15, wherein said drive means further comprises first and second drive shafts operatively rotatably mounted in respective first and second housings affixed to said central deck and connected at their top ends to a propeller shaft of said first and second hydraulic motors, each by means of a releasable coupling, for rotation about respective first and second drive axes.

17. The vertically floating head cutter mechanism of claim 16, wherein said first and second drive shafts are operatively connected at their respective lower ends to said first and second cutter head assemblies.

18. The vertically floating head cutter mechanism of claim 17, wherein said first and second drive axes are coincident with said first and second axes, respectively.

19. The vertically floating head cutter mechanism of claim 18, wherein said first and second drive axes are substantially vertical.

20. The vertically floating head cutter mechanism of claim 18, wherein said first and second drive axes are each inclined at an angle of between zero degrees and ten degrees with respect to vertical.

21. The vertically floating head cutter mechanism of claim 20, wherein said first and second drive axes are each inclined at an angle of about three degrees with respect to vertical.

22. The vertically floating head cutter mechanism of claim 21, wherein said first drive axis is inclined forwardly and upwardly, and said second drive axis is inclined rearwardly and upwardly.

23. The vertically floating head cutter mechanism of claim 22, wherein a portion of said first and second drive shafts are rotationally mounted in substantially centrally disposed bores defined in said first and second housings, respectively, by means of upper and lower tapered roller bearings mounted within the bores.

24. The vertically floating head cutter mechanism of claim 23, wherein said first and second housings are securely mounted, as aforesaid, on said substantially horizontal central deck by means of first and second annular mounting members, said first and second annular mounting members having respective first and second cylindrical passageways with longitudinal axes coincident with said first and second drive axes, respectively.

25. The vertically floating head cutter mechanism of claim 24, wherein said first and second housings are rigidly retained in close fitting relation within said first and second passageways, respectively.

26. The vertically floating head cutter mechanism of claim 25, wherein each of said first and second cutter head assemblies comprises a base member secured to a respective drive shaft for coincident rotation therewith about the respective of said first and second drive axes.

27. The vertically floating head cutter mechanism of claim 26, wherein each of said first and second cutter head assemblies comprises a plurality of annular cutter heads each rotatably mounted on a respective stub axle, said stub axles being affixed to said base member in substantially evenly spaced radially outwardly projecting relation.

28. The vertically floating head cutter mechanism of claim 27, wherein the axes of rotation of each of said annular cutter heads of said first and second cutter head assemblies, respectively, are angled upwardly and radially outwardly from said base member at an angle with respect to horizontal, which angle is substantially equal to the angle of inclination of said first and second drive axes.

29. The vertically floating head cutter mechanism of claim 28, wherein said plurality of annular cutter heads comprises six annular cutter heads.

30. The vertically floating head cutter mechanism of claim 29, wherein said six cutter heads comprise three annular cutter heads having three spaced apart annular rows of cutting teeth and three annular cutter heads having four spaced apart annular rows of cutting teeth, disposed in an alternating pattern around said base member.

31. The vertically floating head cutter mechanism of claim 30, wherein said generally centrally disposed bores of said first and second housings are each adapted to contain a bath of lubricant for lubrication of an exterior portion of said drive shafts and said upper and lower tapered roller bearings.

32. The vertically floating head cutter mechanism of claim 31, wherein said lubricant in said bores is supplied by a remote lubricant reservoir disposed on said central deck of said mounting shroud.

33. The vertically floating head cutter mechanism of claim 32, wherein said first and second drive shafts each have at least one radial passageway extending in fluid communication between said exterior portion of said drive shaft and an axially disposed longitudinal passageway within said drive shaft so as to connect said generally centrally disposed bores of said first and second housings in fluid communication with a central chamber in said base member of the respective cutter head assembly, so as to lubricate said cutter head assembly.

34. The vertically floating head cutter mechanism of claim 33, wherein said each of said annular cutter heads is operatively mounted for rotation on said stub axles, as aforesaid, by means of inner and outer tapered roller bearings retained in central bores in the respective annular cutter head.

35. The vertically floating head cutter mechanism of claim 34, wherein said stub axles of each of said first and second cutter head assemblies each has an axially disposed longitudinal passageway in fluid communication at a proximal end thereof with said central chamber in said base member of the respective cutter head assembly, and in fluid communication at an opposite distal end with one or more radial passageways, which radial passageways are in fluid communication with a said central bore in the respective annular cutter head, so as to provide for passage of said lubricant to said inner and outer tapered roller bearings of the respective annular cutter head.

36. The vertically floating head cutter mechanism of claim 35, further comprising horizontally oriented springs disposed in operative relation between said mounting shroud and each of said frame members for controlling lateral movement of said first and second cutter head assemblies.

37. The vertically floating head cutter mechanism of claim 35, further comprising a pair of substantially parallel linking arms each pivotally mounted at one end to said vehicle and pivotally mounted at an opposite other end to said intermediate platform, to assist in moving said intermediate platform between said lower zone of engagement positions and said upper zone of non-engagement positions.

38. The vertically floating head cutter mechanism of claim 9, wherein said hydraulically actuated cylinder is operatively interconnected to said vehicle as aforesaid by means of a mounting frame having an inverted "U"-shaped stationary member rigidly secured to said vehicle and a smaller substantially congruent inverted "U"-shaped pivoting member operatively mounted in nesting relation within said inverted "U"-shaped stationary member for selective pivotal movement through at least ninety degrees of movement about a substantially horizontal axis passing through the arms of said stationary and pivoting members between an in-use configuration and an access configuration, thus permitting ready access to said open bottom of the mounting shroud and to said first and second cutter head assemblies when in said rotated access configuration.

* * * * *